US010786723B1

(12) United States Patent
Loftus

(10) Patent No.: US 10,786,723 B1
(45) Date of Patent: Sep. 29, 2020

(54) GOLF PRACTICE DEVICE, AND METHOD OF PRACTICING GOLF SWINGS BY HITTING GOLF BALLS FROM REPLICATED SLOPING TOPOGRAPHICAL CONDITIONS, WHICH INCLUDE SIDE-HILL LIES, UP-HILL LIES, AND/OR DOWN-HILL LIES, ENCOUNTERED ON A GOLF COURSE, OFF A SIMULATED FAIRWAY AND/OR A SIMULATED ROUGH

(71) Applicant: Kevin Loftus, Newtown Square, PA (US)

(72) Inventor: Kevin Loftus, Newtown Square, PA (US)

( * ) Notice: Subject to any disclaimer, the term of this patent is extended or adjusted under 35 U.S.C. 154(b) by 0 days.

(21) Appl. No.: 16/674,351

(22) Filed: Nov. 5, 2019

(51) Int. Cl.
*A63B 69/36* (2006.01)
*A63B 71/02* (2006.01)
*E01C 13/08* (2006.01)

(52) U.S. Cl.
CPC ..... *A63B 69/3661* (2013.01); *A63B 71/023* (2013.01); *E01C 13/08* (2013.01); *A63B 2071/024* (2013.01); *A63B 2209/00* (2013.01); *A63B 2209/08* (2013.01)

(58) Field of Classification Search
CPC ..... A63B 69/3661; A63B 71/023; A63B 2209/00; A63B 2071/024; A63B 2209/08; E01C 13/08
USPC ..... 473/278, 279
See application file for complete search history.

(56) References Cited

U.S. PATENT DOCUMENTS 1,612,291 A 12/1926 Jackson
2,124,123 A 7/1938 Rosengarten
D194,450 S 1/1963 Kraines
3,234,577 A 2/1966 Mann, Jr.
3,430,964 A 3/1969 Budzinski
3,869,128 A 3/1975 Ohashi
3,936,055 A 2/1976 Scott
4,415,620 A 11/1983 Yamazaki et al.
4,479,280 A 10/1984 Yamazaki et al.
(Continued)

FOREIGN PATENT DOCUMENTS

JP 2001-087208 4/2001

OTHER PUBLICATIONS

Thomsen, Jack. (May 13, 2013). Utilize Circular Mats and Variable Lies. Web Pages—Retrieved from Crooked Lies, www.jtgolf.com.
(Continued)

*Primary Examiner* — Nini F Legesse
(74) *Attorney, Agent, or Firm* — John F. A. Earley III; Harding, Earley, Follmer & Frailey, P.C.

(57) ABSTRACT

Portable, lightweight golf practice device from which to hit golf balls comprises a base having an opening extending therethrough, a pan having a flat interior portion surrounded by a border portion, the border portion having a lip and an inner slanted portion that slopes downwardly to the flat interior portion, the pan being mounted on the top surface of the base and having a bottom surface that substantially matches the shape of the top side of the base, a rubber layer affixed to the bottom side of the base, and at least one anchoring device. The inner slanted portion and the flat interior portion are covered with driving range artificial grass that simulates fairway, and the lip of the pan and a portion of a border of the base not covered by the lip of the pan are covered with driving range artificial grass that simulates rough.

24 Claims, 12 Drawing Sheets

(56) References Cited

U.S. PATENT DOCUMENTS

| | | | |
|---|---|---|---|
| 5,031,916 | A | 7/1991 | Boswell |
| 5,046,741 | A | 9/1991 | Ahn |
| 5,154,961 | A | 10/1992 | Reuben |
| 5,340,111 | A | 8/1994 | Froelich |
| 5,460,379 | A | 10/1995 | Cleland |
| 5,470,074 | A | 11/1995 | Hotchkiss et al. |
| 5,527,042 | A | 6/1996 | Spriddle |
| 5,593,355 | A | 1/1997 | Beaver |
| 5,620,546 | A | 4/1997 | Reuben |
| 5,683,306 | A | 11/1997 | Tait et al. |
| 5,820,478 | A | 10/1998 | Wood et al. |
| 5,885,168 | A | 5/1999 | Bair |
| 5,944,615 | A | 8/1999 | Lee |
| RE36,677 | E | 5/2000 | Reuben |
| D429,304 | S | 8/2000 | Browne, Jr. |
| 6,106,409 | A | 8/2000 | Jackson, Jr. |
| 6,179,724 | B1 | 1/2001 | Yang et al. |
| 6,312,345 | B1 | 11/2001 | Pelz |
| 6,623,373 | B2 | 9/2003 | Carlton et al. |
| 6,659,881 | B2 | 12/2003 | Lee |
| 6,663,498 | B2 | 12/2003 | Stipan |
| D491,246 | S | 6/2004 | Walsh et al. |
| 7,131,911 | B2 | 11/2006 | Kim |
| 7,182,994 | B1 | 2/2007 | Scott |
| D557,366 | S | 12/2007 | Witt et al. |
| 9,089,755 | B2 | 7/2015 | Holland |
| D777,864 | S | 1/2017 | Shirakawa et al. |
| 9,586,121 | B1 | 3/2017 | Carlson et al. |
| 2004/0142759 | A1 | 7/2004 | Gianfagna et al. |
| 2005/0049069 | A1 | 3/2005 | Speck |
| 2012/0157221 | A1 | 6/2012 | Rhee |
| 2012/0178546 | A1 | 7/2012 | Park |
| 2017/0021262 | A1 | 1/2017 | Hayakawa |

OTHER PUBLICATIONS

Golf Slope Practicing Machine. Web Pages—Retrieved from Alibaba.com.

True Lie—The Ultimate Golf Training Tool. Web Pages—Retrieved from https://www.trueliegolf.com.

GOLF PRACTICE DEVICE, AND METHOD OF PRACTICING GOLF SWINGS BY HITTING GOLF BALLS FROM REPLICATED SLOPING TOPOGRAPHICAL CONDITIONS, WHICH INCLUDE SIDE-HILL LIES, UP-HILL LIES, AND/OR DOWN-HILL LIES, ENCOUNTERED ON A GOLF COURSE, OFF A SIMULATED FAIRWAY AND/OR A SIMULATED ROUGH

FIELD OF THE INVENTION

The invention relates to a golf practice device, and more particularly concerns a portable, lightweight golf practice device used by a golfer to replicate sloping topographical conditions encountered on a golf course to practice his/her golf swing by hitting golf balls from the replicated sloping topographical conditions, which include side-hill lies, up-hill lies, and/or down-hill lies, encountered on a golf course, off a simulated fairway and/or a simulated rough provided by the golf practice device of the invention.

BACKGROUND OF THE INVENTION

Many golfers go to driving ranges to practice their golf swings. The practice area at driving ranges from which golfers hit balls to practice their golf swings is a flat, horizontally level surface covered with natural grass, artificial turf, or a carpet-like material, and a golfer stands on this practice area while practicing his/her golf swing by hitting golf balls off of this practice area in an effort to develop his/her golf skills and improve his/her golf swing. However, flat horizontally level surfaces are not the only lies found on a typical golf course, which unlike the practice area at driving ranges, includes a variety of terrain, and a golf ball often comes to rest on the golf course in a position other than a flat, horizontally level playing surface. It is not uncommon for a golf fairway, rough, or sand trap to include mounds, hills, and depressions, requiring the golfer to strike the golf ball from other than a flat, horizontally level surface. On the golf course, the golfer may find that he/she may have to hit his/her ball as he/she stands on ground that slopes upwardly, or downwardly, or to the right, or to the left, or some combination of these grades. Typically, how the golfer needs to stand to execute a shot will vary from shot to shot as he/she plays his/her round of golf since the terrain of the golf course typically varies throughout the golf course.

The flat, horizontally level practice area at driving ranges fails to provide golfers with a surface that enables golfers to practice their swings by hitting balls from sloped lies that match those found on a golf course. Because golf courses have hills, mounds, depressions, and sloped areas, it is desirable for golfers to practice from sloped surfaces that simulate the terrain of a golf course and that simulate a fairway found on a golf course, where the golfer may vary his/her stance to practice his/her golf swing by hitting golf balls from a sloped surface that simulates the terrain of an actual golf course, especially with respect to hitting shots 150 yards or shorter. The swings needed to hit a golf ball from the many varied sloping topographical conditions found on a golf course differ (and in many cases, differ greatly) from the swings needed to hit a golf ball from a flat, horizontally level surface. For example, the swing planes and stances used often are different. Also, the position of the golf ball with respect to the golfer often is drastically different. For example, when faced with a side-hill lie on a fairway that slopes to the right, a right-handed golfer must extend his/her clubhead below his/her feet level to hit the golf ball, as compared to extending his/her clubhead substantially level with his/her feet to hit a golf ball from a flat, horizontally level surface.

Hitting balls from a flat, horizontally level surface such as that found at a driving range, practices the swings needed to hit a golf ball from a flat, horizontally level surface. It does not practice the actual swings needed for hitting a golf ball from sloping topographical conditions that replicate those found on a golf course and from the many different sloping fairway lies encountered on a golf course, including side-hill lies, up-hill lies, down-hill lies, and combinations of these graded lies, which is a problem.

Known portable, lightweight golf mats, which typically comprise about a 26 inch by about a 12 inch rectangular rubber bottom layer with about a 23 inch by about a 10 inch rectangular layer of artificial turf mounted thereon off of which golf balls may be hit, are designed to be placed upon flat, horizontally level hard surfaces. Such a known mat may be placed on an asphalt driveway when it is desired to practice by hitting golf balls off of the mat and into a net at home during the summer months, or such a known mat may be placed on a concrete garage floor when it is desired to practice by hitting golf balls off of the mat and into a net inside the garage during the cold winter months. While these known golf mats are portable and lightweight, golf balls roll off the artificial turf layer prior to being hit by the golfer if the surface on which these known golf mats is placed is not a substantially flat, horizontally level surface. Also, these known golf mats tend to move from the position they are originally placed on each time a golfer hits a golf ball off of its artificial grass layer.

While a golfer's backyard or a local park may provide a sloping terrain from which to practice golf, if a golfer wishes to practice the swings needed to hit a golf ball from a sloping, undulating golf course fairway by hitting balls in his/her backyard or local park, he/she will find that the surface there from which to hit golf balls is nothing like a golf course fairway, leaving the golfer to practice by hitting golf balls from lies that do not replicate those found on a golf course fairway.

There are a variety of other golf practice devices designed to enable a golfer to practice his/her swing and to simulate various playing situations and conditions encountered on a golf course. However, such devices are generally complex in structure, expensive, and many times heavy in weight, and not easily carried solely by an individual. More so, when such devices are used, the golfer's feet and the golf ball many times are positioned on the same flat, horizontally level plane or the same flat sloping plane, and such planes do not entirely encompass all of the lies from which to hit a golf ball encountered on a golf course.

Accordingly, a need continues to exist for new training devices that enable a golfer to practice his/her golf swing (to improve his/her golf skills) by hitting golf balls from sloping topographical conditions that replicate those found on a golf course and from the many different lies encountered on a golf course, including side-hill lies, up-hill lies, down-hill lies, and combinations of these graded lies, from a simulated fairway and/or simulated rough.

SUMMARY OF THE INVENTION

It is an object of the invention to provide a golf practice device which, when put into use, simulates a wide variety of conditions found on a golf course such that the golfer may practice his/her golf swing (to improve his/her golf skills) by hitting golf balls from sloping topographical conditions that replicate those found on a golf course and from the many different lies encountered on a golf course, including side-hill lies, up-hill lies, down-hill lies, and combinations of these graded lies, from a simulated fairway and/or a simulated rough.

Another object of the invention is to provide a golf practice device that is portable and lightweight, such that it may be easily carried by an individual without the help of anyone else and placed into use (i.e., placed onto a substrate, and, when the substrate is a natural substrate like soil, sand, or grass-covered soil, placed onto a substrate and anchored in place to the substrate) by an individual without the help of anyone else.

Another object of the invention is to provide a portable, lightweight practice device that may be used on surfaces that are not horizontally level, as well as surfaces that are horizontally level.

Still another object of the invention is to provide a portable, lightweight golf practice device that may be secured in place during use so that the golf practice device when secured in place does not move from the position on which it has been placed each time a golfer hits a ball off of the golf practice device.

These and other objects are accomplished by my invention, which is set out in detail below.

My invention enables a golfer to practice away from the golf course the actual swings needed to hit a golf ball from sloping terrain (that is, the many varied sloping topographical conditions) encountered on a golf course, by hitting golf balls from sloping topographical conditions that replicate those found on a golf course, which the prior art is unable to do. My invention enables a golfer to practice away from the golf course the actual swings needed to hit a golf ball from sloping terrain (that is, the many varied sloping topographical conditions) encountered on a golf course, by hitting golf balls from many varied sloping topographical conditions that replicate those encountered on a golf course, including side-hill lies, up-hill lies, down-hill lies, and combinations of these graded lies, from a simulated fairway and/or simulated rough, which the prior art is unable to do.

Rather than merely practicing the swings needed to hit a golf ball from a flat, horizontally level surface by hitting golf balls from a flat, horizontally-level surface such as that found at a driving range, and then guessing at the adjustments needed to be made to such swings when facing a golf shot from sloping topographical conditions found on a golf course when playing a round of golf, my invention enables a golfer to replicate the many varied sloping topographical conditions encountered on a golf course, so that the golfer can actually practice away from the golf course the actual swings needed to hit golf shots from the many varied sloping topographical conditions, which include side-hill lies, up-hill lies, and/or down-hill lies, that are encountered on a golf course, by hitting golf balls from many varied sloping topographical conditions that replicate those encountered on a golf course, and so that the golfer can actually practice away from the golf course the actual swings needed to hit golf shots from the many varied sloping topographical conditions, which include side-hill lies, up-hill lies, and/or down-hill lies, that are encountered on a golf course, by hitting golf balls from many varied sloping topographical conditions that replicate those encountered on a golf course, including side-hill lies, up-hill lies, down-hill lies, and combinations of these graded lies, from a simulated fairway and/or simulated rough.

Further, my invention enables a golfer to replicate the many varied sloping topographical conditions encountered on a golf course, so that the golfer can actually practice away from the golf course the actual swings needed to hit golf shots from the many varied sloping topographical conditions, which include side-hill lies, uphill lies, and/or down-hill lies, that are encountered on a golf course by hitting golf balls from sloping topographical conditions that replicate those found on a golf course, including side-hill lies, up-hill lies, down-hill lies, and combinations of these graded lies, from a simulated fairway and/or simulated rough, wherein the golfer may vary his/her stance (sometimes having the bottom of each foot of the golfer oriented in different planes from one another and in a different plane in which the golf ball lies) so that the golfer is placed in an appropriate position to practice the actual swing needed to hit a golf shot from such sloping topographical conditions. In accordance with my invention, the inventive golf practice device 11 may be oriented on and secured to a hill or a mound or the like to replicate a sloping topographical condition that dictates the golf swing that is desired to be practiced and that is needed to hit a golf ball from such a sloping condition. The golfer may then practice the golf swing needed to hit a golf ball from such a condition by following the steps of (a) addressing a golf ball placed on the golf practice device 11 (including arranging his/her stance to correspond with a stance needed to hit a golf ball from such a sloping condition), (b) then hitting the golf ball from off the golf practice device 11, and (c) then hitting golf balls repeatedly from off the golf practice device 11 by repeating steps (a) and (b) over and over in an effort to become proficient at the golf shot (and the swing needed to execute the golf shot) through repetition.

DETAILED DESCRIPTION OF THE DRAWINGS

Figure 1:
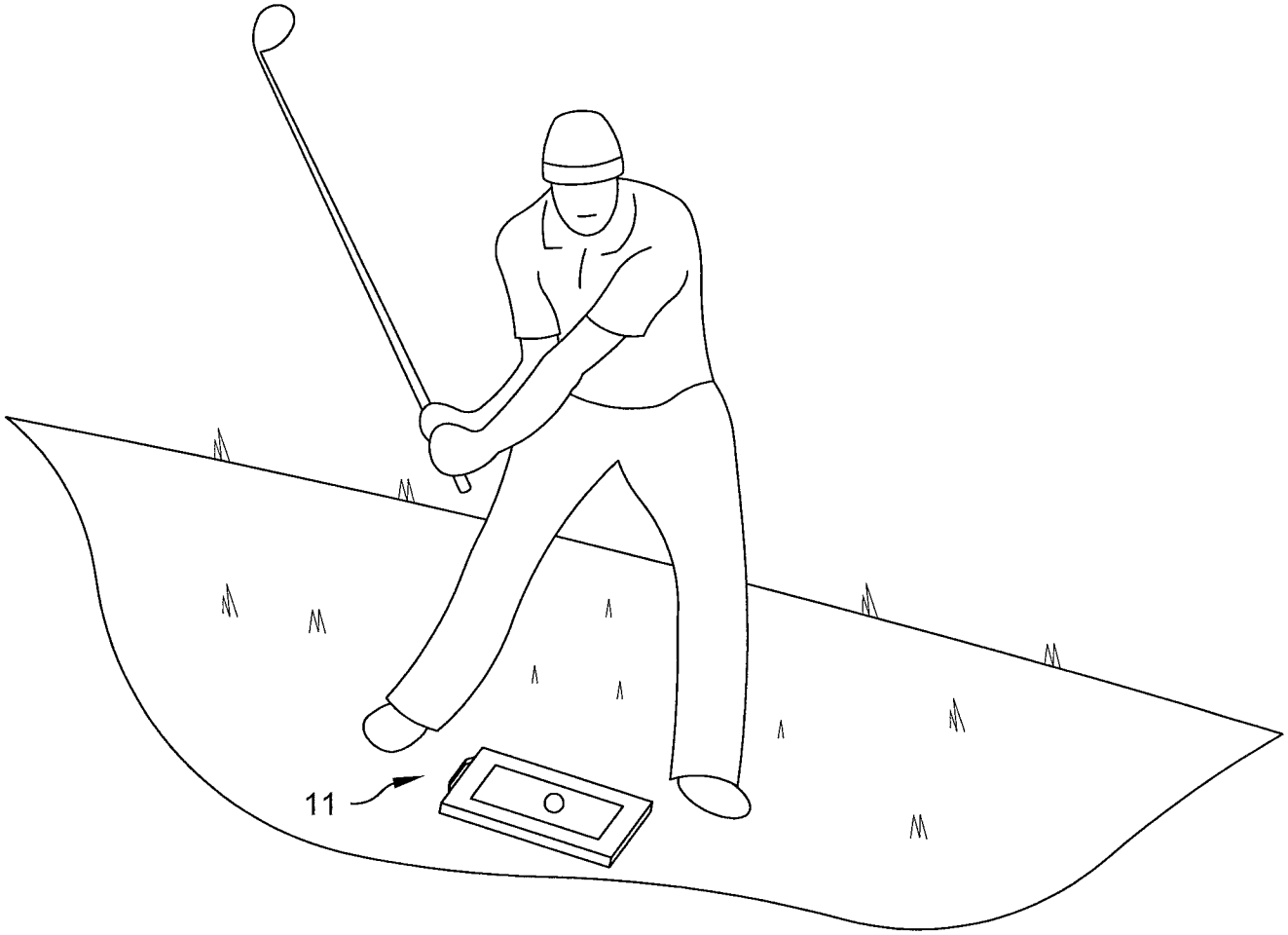
FIG. 1 is a view in perspective of a golfer hitting a golf ball from the portable, lightweight golf practice device 11 of the invention, which has been placed upon a mound in a park and oriented on the mound to replicate sloping topographical conditions (in this case, a down-hill, side-hill lie) found on a golf course fairway, so that that golfer may practice the swing needed to execute the golf shot from such sloping topographical conditions by hitting golf balls repeatedly off of the golf practice device 11 oriented on the mound to replicate such sloping conditions.

Turning to the drawings, there is shown in FIGS. 1-10 my inventive portable, lightweight golf practice device 11 from which to hit golf balls. My golf practice device 11 may be used by a golfer to replicate the many varied sloping topographical conditions encountered on a golf course to practice his/her golf swing by hitting golf balls from the replicated sloping topographical conditions, which include side-hill lies, up-hill lies, and/or down-hill lies encountered on a golf course, off a simulated fairway and/or a simulated rough provided by the golf practice device 11 of the invention.

My inventive golf practice device 11 has a base 13 that has a top side 15, a bottom side 17, a border portion 19, and an opening 21 extending through the base 13 and surrounded by the border portion 19. The opening 21 has a perimeter 23.

The bottom side 17 of the base 13 has a bottom surface 25.

The border portion 19 of the base 13 has an outer area 27 and an inner slanted portion 29 that slopes downwardly from the outer area 27 of the border portion 19 of the base 13 to the opening 21. The outer area 27 of the border portion 19 of the base 13 has a top surface 28, an outer edge 24, and an inner edge 26, and the inner slanted portion 29 of the border portion 19 of the base 13 has a top surface 31.

In the preferred embodiment shown in the drawings, the base 13 is rectangular in shape, and preferably has a width of about 18 inches and a length of about 24 inches. In this preferred embodiment, the base 13 has an outer periphery 32, and the border portion 19 of the base 13 at the outer periphery 32 of the base 13 is about ⅞ inches in height. However, in other preferred embodiments, the width of the base 13 may range from about 17 inches to about 21 inches, the length of the base 13 may range from about 23 inches to about 26 inches, and the height of the base 13 at the outer periphery of the base 13 may range from about ⅞ inches to about 2 inches.

Figure 9:
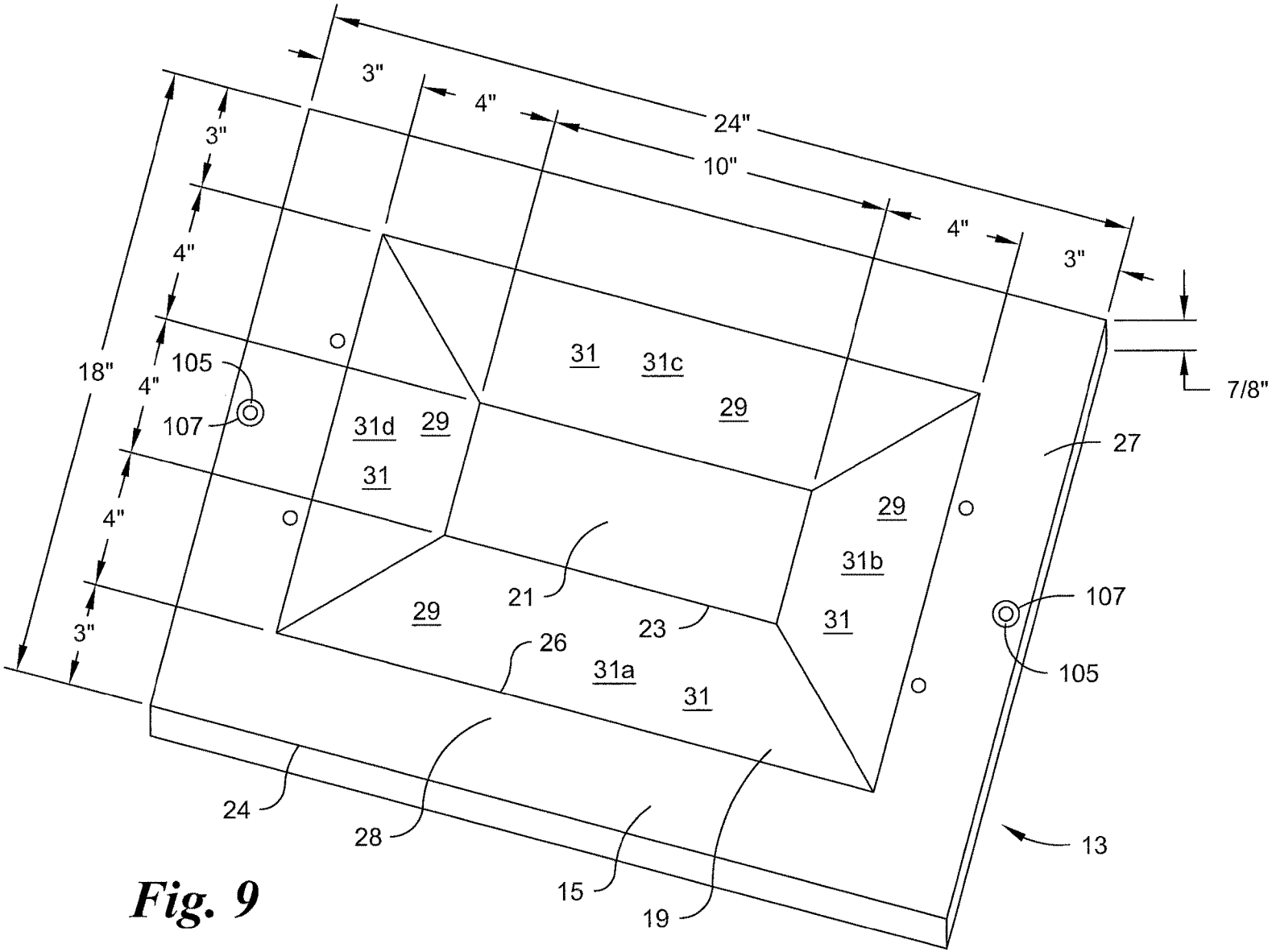
FIG. 9 is a view in perspective of the base 13, showing preferred dimensions of the base 13.
Figure 10:
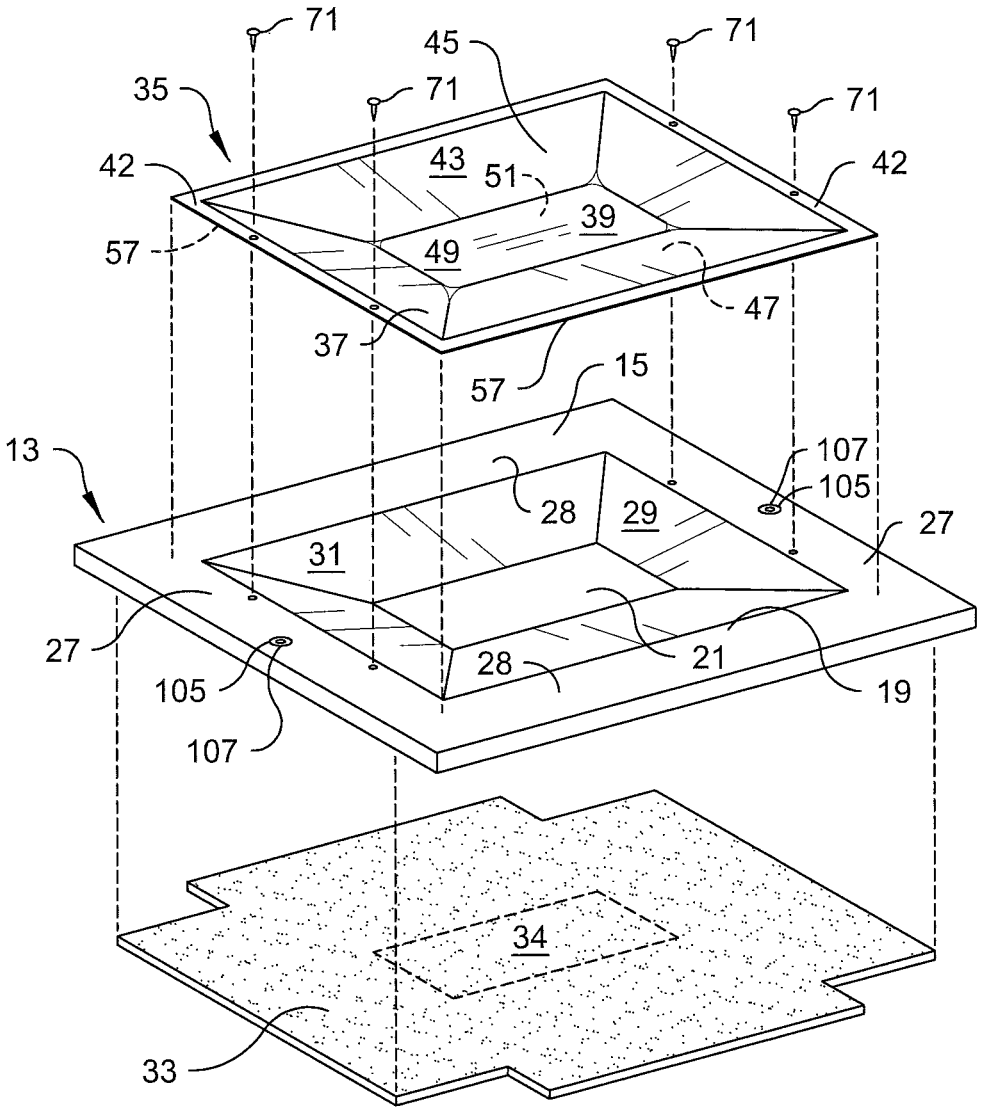
FIG. 10 is an exploded view in perspective of a partial assembly, illustrating the base 13 (with plastic receiver inserts 105 mounted thereon), the pan 35, the screws 71 for securing the pan 35 to the base 13, and the rubber layer 33 of the golf practice device 11. The artificial driving range grass 65, the artificial driving range grass 67, the hinged anchoring devices 77, the magnets 91, the handle 99, and the screws 103 to secure the handle 99 to the base 13 are not shown in FIG. 10.

Preferably, as shown in FIG. 9, the outer area 27 of the border portion 19 of the base 13 has a width of about 3 inches (measuring at the top side 15 of the base 13 from the outer edge 24 of outer area 27 of the border portion 19 of the base 13 to the inner edge 26 of the outer area 27 of the border portion 19 of the base 13 (that is, the inner edge 26 of the outer area 27 being where the outer area 27 meets the inner slanted portion 29 of the border portion 19 of the base 13) along a line that extends therebetween and is perpendicular to the edges 24 and 26). However, in other preferred embodiments, this width may range from about 2.5 inches to about 3 inches (measuring at the top side 15 of the base 13 from the outer edge 24 of outer area 27 of the border portion 19 of the base 13 to the inner edge 26 of the outer area 27 of the border portion 19 of the base 13 (that is, the inner edge 26 of the outer area 27 being where the outer area 27 meets the inner slanted portion 29 of the border portion 19 of the base 13) along a line that extends therebetween and is perpendicular to the edges 24 and 26).

Figure 12:
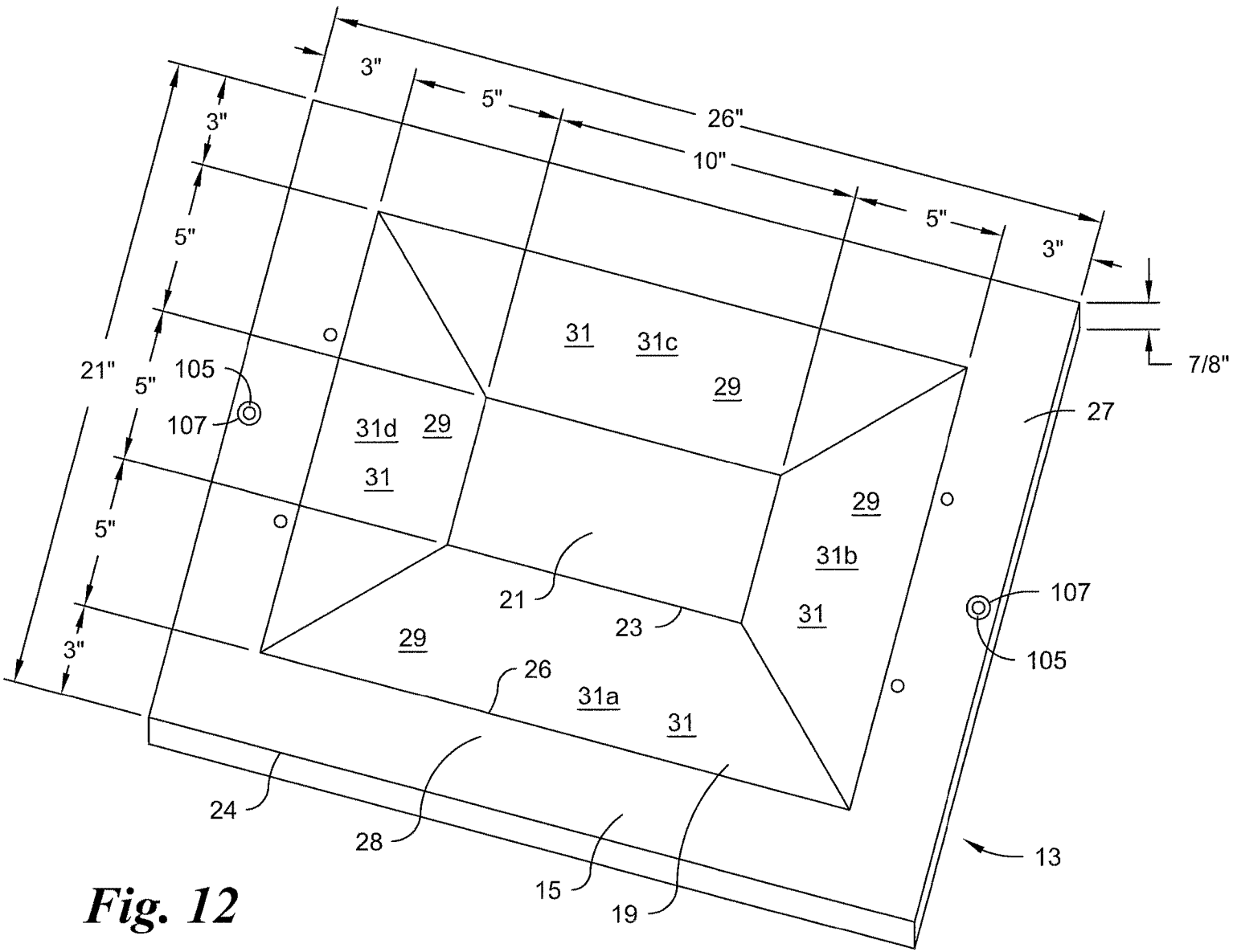
FIG. 12 is a view in perspective of another preferred embodiment of the base 13 of the golf practice device 11, showing other preferred widths and lengths of the base 13.

Preferably, as shown in FIG. 9, the inner slanted portion 29 of the border portion 19 of the base 13 has a width of about 4 inches (measuring by how far inwardly the inner slanted portion 29 extends from the inner edge 26 of the outer area 27 of the border portion 19 of the base 13 to the opening 21 extending through the base 13 at the bottom surface 25 of the base 13, rather than by measuring along the top surface 31 of the inner slanted portion 29 from the inner edge 26 of the outer area 27 of the border portion 19 of the base 13 to the opening 21 extending through the base 13 at the bottom surface 25 of the base 13). However, in other preferred embodiments, this width may range from about 4 inches to about 6 inches (measuring by how far inwardly the inner slanted portion 29 extends from the inner edge 26 of the outer area 27 of the border portion 19 of the base 13 to the opening 21 extending through the base 13 at the bottom surface 25 of the base 13, rather than by measuring along the top surface 31 of the inner slanted portion 29 from the inner edge 26 of the outer area 27 of the border portion 19 of the base 13 to the opening 21 extending through the base 13 at the bottom surface 25 of the base 13). For example, as shown in FIG. 12, in one such preferred embodiment, the inner slanted portion 29 of the border portion 19 of the base 13 has a width of about 5 inches (measuring by how far inwardly the inner slanted portion 29 extends from the inner edge 26 of the outer area 27 of the border portion 19 of the base 13 to the opening 21 extending through the base 13 at the bottom surface 25 of the base 13, rather than by measuring along the top surface 31 of the inner slanted portion 29 from the inner edge 26 of the outer area 27 of the border portion 19 of the base 13 to the opening 21 extending through the base 13 at the bottom surface 25 of the base 13).

Figure 3:
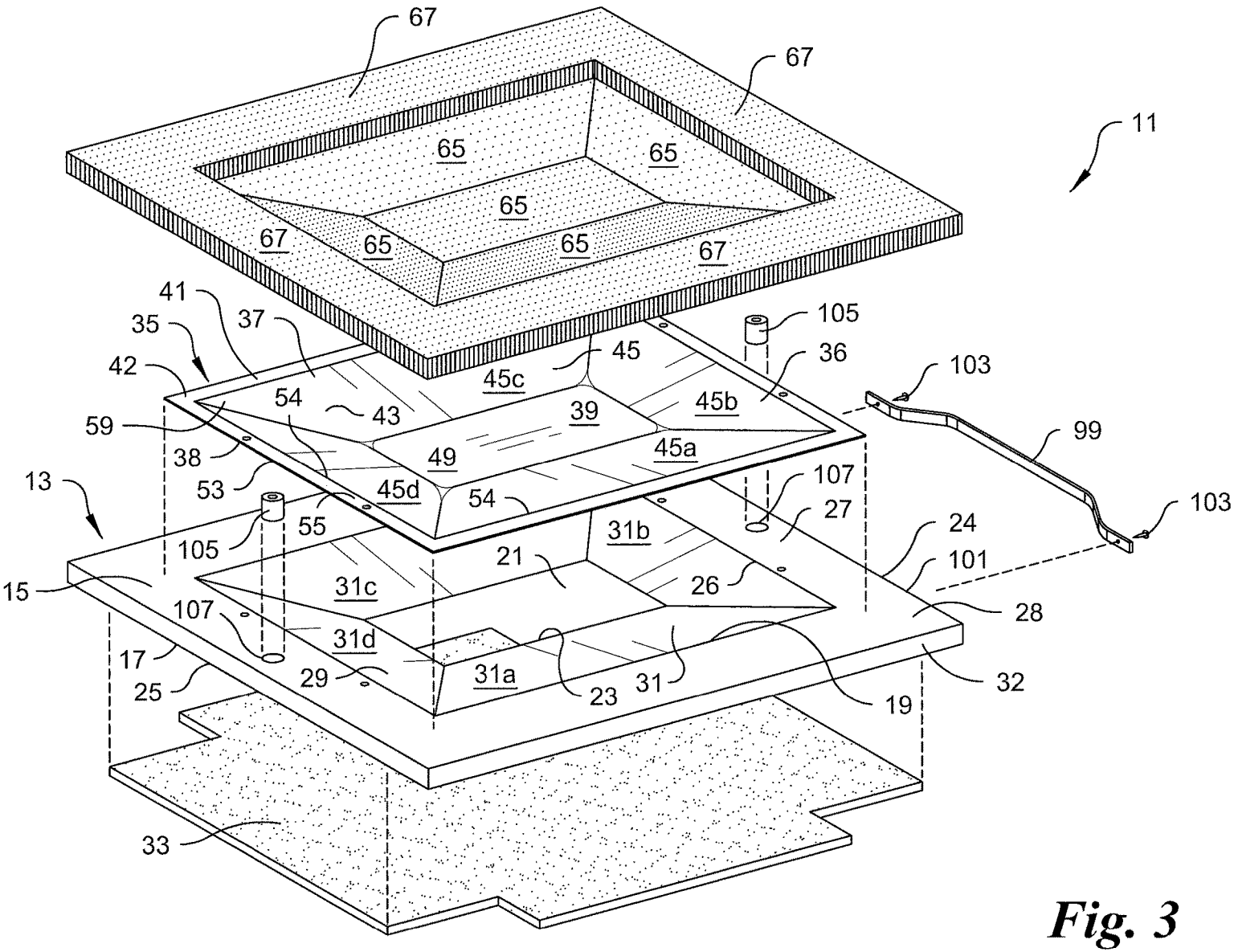
FIG. 3 is an exploded view in perspective of a partial assembly of the portable, lightweight golf practice device 11, showing the base 13, the rubber layer 33, the pan 35, the handle 99 which may be grasped when carrying the golf practice device 11 from one location to another, and the plastic receiver inserts 105 for receiving and holding a golf tee so that a golf ball may be place on top of a golf tee that extends from the plastic receiver insert 105 to elevate the golf ball above the top surface 25 of the outer area 27 of the border portion 19 of the base 13 at a height desired from which to hit a drive. The hinged anchoring devices 77, magnets 91, screws 71 for securing the pan 35 to the base 13, and screws 103 for screwing the handle 99 to the base 13 are not shown in FIG. 3.
Figure 4A:
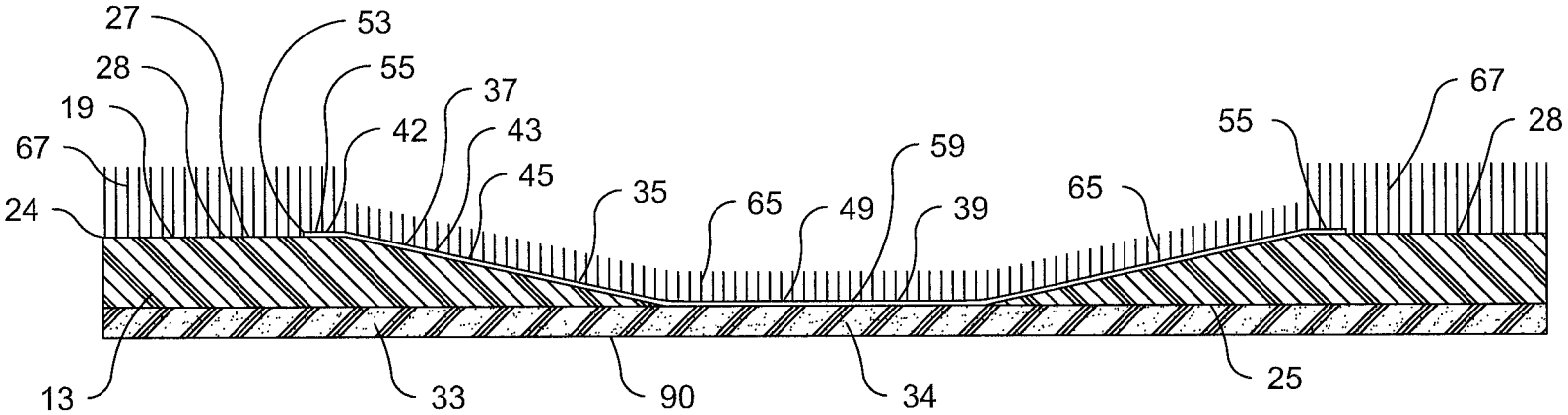
FIG. 4A is a view in cross-section taken along the lines and arrows 4A-4A shown in FIG. 2.
Figure 4B:
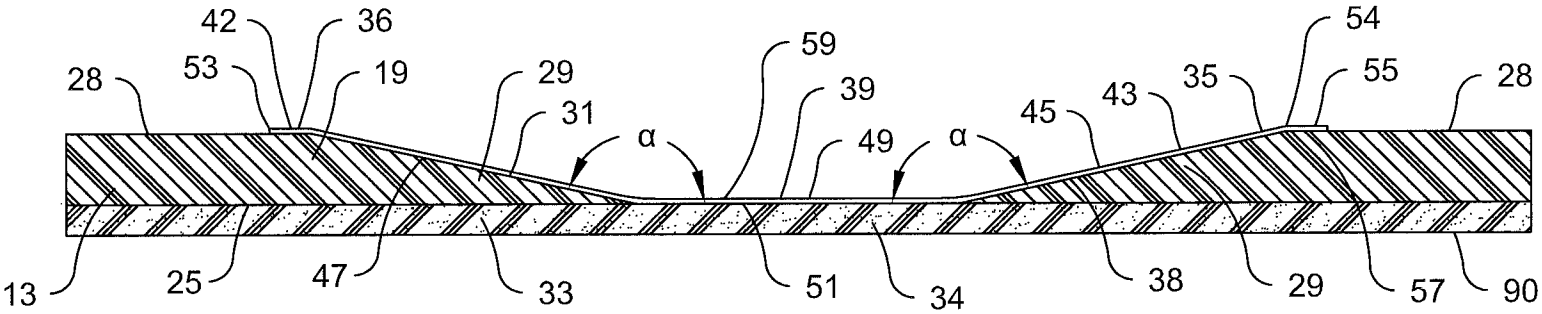
FIG. 4B is a view in cross-section of a partial assembly of the golf practice device 11 shown in FIG. 4A, without the artificial driving range grass 65 and the artificial driving range grass 67 being shown.

In the preferred embodiment shown in FIGS. 3, 4A, 4B, 9, and 10, throughout the base 13 the inner slanted portion 29 of the border portion 19 of the base 13 slopes downwardly such that the angle ∝ shown in FIG. 4B between the top surface 31 of the inner slanted portion 29 and a plane extending through and parallel to the bottom surface 25 of the base 13 is about 167⅔ degrees. However, in other preferred embodiments, this angle ∝ may be changed, when forming the base 13, by varying the height (i e, making it higher or lower) of the base 13 at the inner edge 26 of the outer area 27 of the border portion 19 of the base 13 and/or by varying the width (i.e., making it shorter or longer) of the inner slanted portion 29 of the border portion 19 of the base 13 (measuring by how far inwardly the inner slanted portion 29 extends from the inner edge 26 of the outer area 27 of the border portion 19 of the base 13 to the opening 21 extending through the base 13 at the bottom surface 25 of the base 13, rather than by measuring along the top surface 31 of the inner slanted portion 29 from the inner edge 26 of the outer area 27 of the border portion 19 of the base 13 to the opening 21 extending through the base 13 at the bottom surface 25 of the base 13).

In the preferred embodiment shown in the drawings at FIGS. 3 and 9, the top surface 31 of the inner slanted portion 29 comprises four sections 31*a*, 31*b*, 31*c*, and 31*d*, and preferably, the top surface 31 of the inner slanted portion 29 where adjacent sections thereof meet (that is, where section 31*a* meets section 31*b*, where section 31*b* meets sections 31*c*, where section 31*c* meets section 31*d*, and where section 31*d* meets section 31*a*) is rounded out so that the angle between these adjacent sections of the top surface 31 of the inner slanted portion 29 is not a sharp angle. However, this rounding is optional.

As may be seen in FIG. 9, the four sections 31*a*, 31*b*, 31*c*, and 31*d* preferably have an isosceles trapezoid shape, and preferably the length of the inner slanted portion 29 of the border portion 19 of the base 13 at sections 31*b* and 31*d* where sections 31*b* and 31*d* meet the outer area 27 of the border portion 19 of the base 13 (that is, at the inner edge 26 of the outer area 27) is about 12 inches. However, in other preferred embodiments, this length at sections 31*b* and 31*d* along the inner edge 26 may range from about 12 inches (for example, see FIG. 9) to about 15 inches (for example, see FIG. 12). Preferably, the length of the inner slanted portion 29 of the border portion 19 of the base 13 at sections 31*b* and 31*d* where sections 31*b* and 31*d* meet the opening 21 in the base 13 at the bottom surface 25 of the base 13 is about 4 inches, and in other preferred embodiments ranges from about 4 inches (for example, see FIG. 9) to about 5 inches (for example, see FIG. 12), matching whatever the width of the opening 21 in the base 13 at the bottom surface 25 of the base 13 is.

Further, as may be seen in FIG. 9, preferably the length of the inner slanted portion 29 of the border portion 19 of the base 13 at sections 31*a* and 31*c* where sections 31*a* and 31*c* meet the outer area 27 of the border portion 19 of the base 13 (that is, at the inner edge 26 of the outer area 27) is about 18 inches. However, in other preferred embodiments, this length at sections 31*a* and 31*c* along the inner edge 26 may range from about 18 (for example, see FIG. 9) inches to about 20 inches (for example, see FIG. 12). Preferably, the length of the inner slanted portion 29 of the border portion 19 of the base 13 at sections 31*a* and 31*c* where sections 31*a* and 31*c* meet the opening 21 in the base 13 at the bottom surface 25 of the base 13 is about 10 inches.

The opening 21 in the base 13 at the bottom surface 25 of the base 13 in the preferred embodiment shown in FIGS. 3, 4A, 4B, 9, and 10 is rectangular in shape and has a width of about 4 inches and a length of about 10 inches. However, in other preferred embodiments of the invention, the opening 21 in the base 13 at the bottom surface 25 of the base 13 may be rectangular in shape and have a width in a range of about 4 inches (for example, see FIGS. 3, 4A, 4B, 9, and 10) to about 5 inches (for example, see FIG. 12), and a length of about 10 inches. While the preferred shape of the opening 21 in the base 13 at the bottom surface 25 of the base 13 is rectangular, other shapes may be used so long as they match the shape of the flat central portion 39 of a pan 35 described below.

Preferably, the base 13 is made of a strong plastic material, such as acrylonitrile-butadiene-styrene (ABS), ultra high molecular weight polyethylene (UHMWPE), polypropylene (PP), polyethylene terephthalate (PETE or PET), or polyvinyl chloride (PVC), preferably by molding.

A rubber layer 33 is affixed, preferably with an adhesive, to the bottom surface 25 of the base 13. The rubber layer 33 has a portion 34 that extends across the opening 21 in the base 13. In the preferred embodiment shown in the drawings, the rubber layer 33 has a thickness of about 0.5 inches. However, in other preferred embodiments, the thickness of the rubber layer 33 may range from about ⅜ inches to about ⅝ inches. Still, in other preferred embodiments, the thickness of the rubber layer 33 may be thicker than ⅝ inches (such as 0.75 inches), preferably with a ribbed support structure to minimize the weight of the rubber layer 33.

In the preferred embodiment shown in the drawings, a pan 35 also is provided. The pan 35 in this preferred embodiment is rectangular in shape, and preferably has a width of about 13 inches and a length of about 19 inches. However, in other preferred embodiments, the width of the pan 35 may range from about 12% inches to about 16 inches, and the length of the pan 35 may range from about 18¾ inches to about 21 inches. The pan 35 has a top side 36, a bottom side 38, a border portion 37, and a flat interior portion 39 surrounded by the border portion 37 of the pan 35. The border portion 37 of the pan 35 has an outer area 41, which forms a lip 42 of the pan 35, and an inner slanted portion 43 that slopes downwardly from the outer area 41 of the border portion 37 of the pan 35 (that is, from lip 42) to the flat interior portion 39 of the pan 35. The lip 42 strengthens the structure of the pan 35 and the overall structure of the device 11, and provides a location to attach the pan 35 to the base 13. The inner slanted portion 43 of the border portion 37 of the pan 35 has a top surface 45 and a bottom surface 47, and the flat interior portion 39 of the pan 35 has a top surface 49 and a bottom surface 51. The lip 42 has an outer edge 53, an inner edge 54, a top surface 55, and a bottom surface 57. The pan 35 preferably has a thickness that is substantially the same throughout, and in the preferred embodiment of the invention shown in the drawings, the pan 35 has a thickness that is preferably less than or equal to about ⅛ of an inch, and more preferably is about ⅛ of an inch. In other preferred embodiments of the invention, the preferred thickness of the pan 35 ranges from about 1/16 inches to about ⅛ inches.

Preferably, the lip 42 of the pan 35 has a width of about ½ inch (measuring at the top side 36 of the pan 35 from the outer edge 53 of the lip 42 of the border portion 37 of the pan 35 to the inner edge 54 of the lip 42 of the border portion 37 of the pan 35 (that is, where the lip 42 meets the inner slanted portion 43 of the border portion 37 of the pan 35) along a line that extends therebetween and is perpendicular to the edges 53 and 54 of the lip 42. However, in other preferred embodiments, the width of the lip 42 may range from about ⅜ inches to about ½ inches (measuring at the top side 36 of the pan 35 from the outer edge 53 of the lip 42 of the border portion 37 of the pan 35 to the inner edge 54 of the lip 42 of the border portion 37 of the pan 35 (that is, where the lip 42 meets the inner slanted portion 43 of the border portion 37 of the pan 35) along a line that extends therebetween and is perpendicular to the edges 53 and 54 of the lip 42.

Preferably, the inner slanted portion 43 of the border portion 37 of the pan 35 has a width of about 4 inches (measuring by how far inwardly the inner slanted portion 43 extends from the inner edge 54 of the lip 42 to the flat interior portion 39 of the pan 35, rather than by measuring along the top surface 45 of the inner slanted portion 43 from the inner edge 54 of the lip 42 to the flat interior portion 39 of the pan 35). However, in other preferred embodiments, this width may range from about 4 inches to about 6 inches (measuring by how far inwardly the inner slanted portion 43 extends from the inner edge 54 of the lip 42 to the flat interior portion 39 of the pan 35, rather than by measuring along the top surface 45 of the inner slanted portion 43 from the inner edge 54 of the lip 42 to the flat interior portion 39 of the pan 35). For example, in one such preferred embodiment, the inner slanted portion 43 of the border portion 37 of the pan 35 of the golf practice device 11 has a width of about 5 inches (measuring by how far inwardly the inner slanted portion 43 extends from the inner edge 54 of the lip 42 to the flat interior portion 39 of the pan 35, rather than by measuring along the top surface 45 of the inner slanted portion 43 from the inner edge 54 of the lip 42 to the flat interior portion 39 of the pan 35) to match the width of the inner slanted portion 29 of the border portion 19 of the base 13 shown in FIG. 12.

In the preferred embodiment shown in the FIGS. 3, 4A, 4B, and 10, the inner slanted portion 43 of the border portion 37 of the pan 35 slopes downwardly such that the angle $\propto$ shown in FIG. 4B between the top surface 45 of the inner slanted portion 43 and a plane extending through and parallel to the flat interior portion 39 of pan 35 is about 167⅔ degrees. However, in other preferred embodiments, this angle $\propto$ may be changed, when forming the pan 35, by varying how high the inner slanted portion 43 at the inner edge 54 of the lip 42 is above the plane extending through and parallel to the flat interior portion 39 of the pan 35 and/or by varying the width of the inner slanted portion 43 (measuring by how far inwardly the inner slanted portion 43 extends from the inner edge 54 of the lip 42 to the flat interior portion 39 of the pan 35, rather than by measuring along the top surface 45 of the inner slanted portion 43 from the inner edge 54 of the lip 42 to the flat interior portion 39 of the pan 35).

In the preferred embodiment shown in FIG. 3, the top surface 45 of the inner slanted portion 43 of the pan 35 comprises four sections 45*a*, 45*b*, 45*c*, and 45*d*, and preferably, the top surface 45 of the inner slanted portion 43 where adjacent sections thereof meet (that is, where section 45*a* meets section 45*b*, where section 45*b* meets sections 45*c*, where section 45*c* meets section 45*d*, and where section 45*d* meets section 45*a*) is rounded out so that the angle between these adjacent sections of the top surface 45 of the inner slanted portion 43 is not a sharp angle. However, this rounding is optional.

Similarly, the surface of the bottom side 38 of the pan 35 preferably is rounded out where the bottom surface 47 of the inner slanted portion 43 of the pan 35 meets the bottom surface 51 of the flat interior portion 39 of the pan 35 so that the angle formed between the inner slanted portion 43 of the pan 35 and the flat interior portion 39 of the pan 35 is not a sharp angle. However, this rounding also is optional. This rounding creates a flatter surface, thereby making it easier to hit a ball from where the bottom surface 47 of the inner slanted portion 43 of the pan 35 meets the bottom surface 51 of the flat interior portion 39 of the pan 35.

Preferably, the four sections 45*a*, 45*b*, 45*c*, and 45*d* have an isosceles trapezoid shape, and preferably the length of the inner slanted portion 43 of the border portion 37 of the pan 35 at sections 45*b* and 45*d* where sections 45*b* and 45*d* meet the lip 42 is about 12 inches, and in other preferred embodiments may range from about 12 inches to about 15 inches. Preferably, the length of inner slanted portion 43 of the border portion 37 of the pan 35 at sections 45*b* and 45*d* where sections 45*b* and 45*d* meet the flat interior portion 39 of the pan 35 is about 4 inches, and in other preferred embodiments ranges from about 4 inches to about 5 inches, matching whatever the width of the flat interior portion 39 of the pan 35 is.

Preferably, the length of the inner slanted portion 43 of the border portion 37 of the pan 35 at sections 45*a* and 45*c* where sections 45*a* and 45*c* meet the lip 42 is about 18 inches, and in other preferred embodiments, may range from about 18 inches to about 20 inches. Preferably, the length of inner slanted portion 43 of the border portion 37 of the pan 35 at sections 45*a* and 45*c* where sections 45*a* and 45*c* meet the flat interior portion 39 of the pan 35 is about 10 inches.

Preferably, the flat interior portion 39 of the pan 35 has a width of about 4 inches and a length of about 10 inches. However, in other preferred embodiments, the width of the flat interior portion 39 of the pan 35 may range from about 4 inches to about 5 inches, and the length of the flat interior portion 39 of the pan 35 may be about 10 inches. While the preferred shape of the flat interior portion 39 of the pan 35 is rectangular, other shapes may be used so long as they match the shape of the opening 21 in the base 13 at the bottom surface 25 of the base 13.

Preferably, the pan 35 is made of a strong material, such as sheet metal, preferably steel.

In each of the preferred embodiments, the inner slanted portion 43 of the border portion 37 of the pan 35 is shaped to substantially match the top surface 31 of the inner slanted portion 29 of the border portion 19 of the base 13, the flat interior portion 39 of the pan 35 is shaped to substantially match the perimeter 23 of the opening 21 at the bottom surface 25 of the base 13 such that the flat interior portion 39 of the pan 35 may extend into the opening 21 at the perimeter 23 of the opening 21 at the bottom surface 25 of the base 13, and the lip 42 of the pan 35 is shaped to substantially match a portion of the top surface 28 of the outer area 27 of the border 19 of the base 13. The pan 35 is positioned on the base 13 such that the inner slanted portion 43 of the border portion 37 of the pan 35 is aligned with and positioned on the inner slanted portion 29 of the border portion 19 of the base 13, with the bottom surface 47 of the inner slanted portion 43 of the pan 35 contacting the top surface 31 of the inner slanted portion 29 of the border portion 19 of the base 13, and the flat interior portion 39 of the pan 35 is aligned with the opening 21 extending through the base 13, with the bottom surface 51 of the flat interior portion 39 of the pan 35 extending into the opening 21 and contacting the portion 34 of the rubber layer 33 that extends across the opening 21 in the base 13. Also, as shown in the preferred embodiment illustrated in FIGS. 3, 4A, 4B, and 10, the lip 42 of pan 35 is aligned with and positioned on the outer area 27 of the border portion 19 of the base 13 with the bottom surface 57 of the lip 42 resting upon a portion of the top surface 28 of the outer area 27 of the border portion 19 of the base 13. Accordingly, the pan 35 sits snugly on the base 13 since the shape and dimensions of the bottom side 38 of the pan 35 substantially match the shape and dimensions of the top side 15 of the base 13, with the lip 42 of the pan 35 positioned on a portion of the outer area 27 of the border portion 19 of the base 13, with the inner slanted portion 43 of the border portion 37 of the pan 35 positioned on the inner slanted portion 29 of the border portion 19 of the base 13, and the flat interior portion 39 of the pan 35 extending into the opening 21 in the base 13 filling the opening 21 in the base 13 at the bottom surface 25 of the base 13 and positioned on the portion 34 of the rubber layer 33 that extends across the opening 21 in the base 13.

In the preferred embodiment shown in the drawings, the pan 35 is secured to the base 13 with the use of retaining screws 71 that extend through the lip 42 of the pan 35 and into the outer area 27 of the border portion 19 of the base 13 to securely hold the pan 35 to the top side 15 of the base 13. In addition to, or alternatively, adhesive may be applied between the bottom surface 57 of the lip 42 and the top surface 28 of a portion of the outer area 27 of the border portion 19 of the base 13 that the lip 42 overlaps, and/or between the bottom surface 47 of the inner slanted portion 43 of the border portion 37 of the pan 35 and the top surface 31 of the inner slanted portion 29 of the border portion 19 of the base 13, to adhere the pan 35 in place on the base 13.

The top surface 45 of the inner slanted portion 43 of the border portion 37 of pan 35 and the top surface 49 of the flat interior portion 39 of the pan 35 are covered with driving range artificial grass 65, preferably driving range artificial grass that simulates golf course fairway. The driving range artificial grass 65 is secured to the top surfaces 45 and 49 preferably with an adhesive. In the preferred embodiment shown in the drawings, the top surface 55 of the lip 42 and the top surface 28 of the outer area 27 of the border portion 19 of the base 13 between the outer edge 24 of the outer area 27 and the outer edge 53 of the lip 42 of the pan 35 are covered with driving range artificial grass 67, preferably driving range artificial grass that simulates golf course rough. The driving range artificial grass 67 is secured to the top surface 55 of the lip 42 and the top surface 28 of the outer area 27 of the border portion 19 of the base 13 between the outer edge 24 of the outer area 27 and the outer edge 53 of the lip 42 of the pan 35 preferably with an adhesive.

Figure 2:
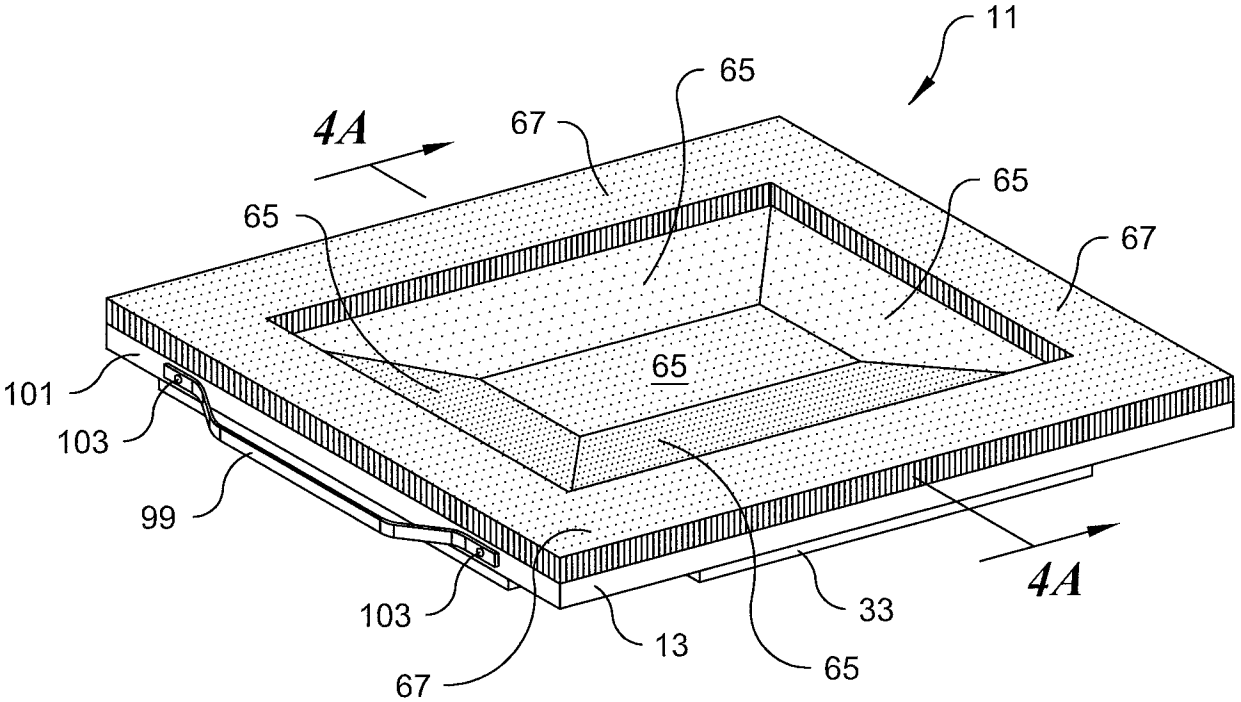
FIG. 2 is a view in perspective of the portable, lightweight golf practice device 11, constructed in accordance with the invention.

In the preferred embodiment of the invention shown in shown in FIGS. 2, 3, and 4A, the driving range artificial grass 65 is about 0.5 inches or so in height, and the driving range artificial grass 67 is about 1.5 inches or so in height.

Figure 11:
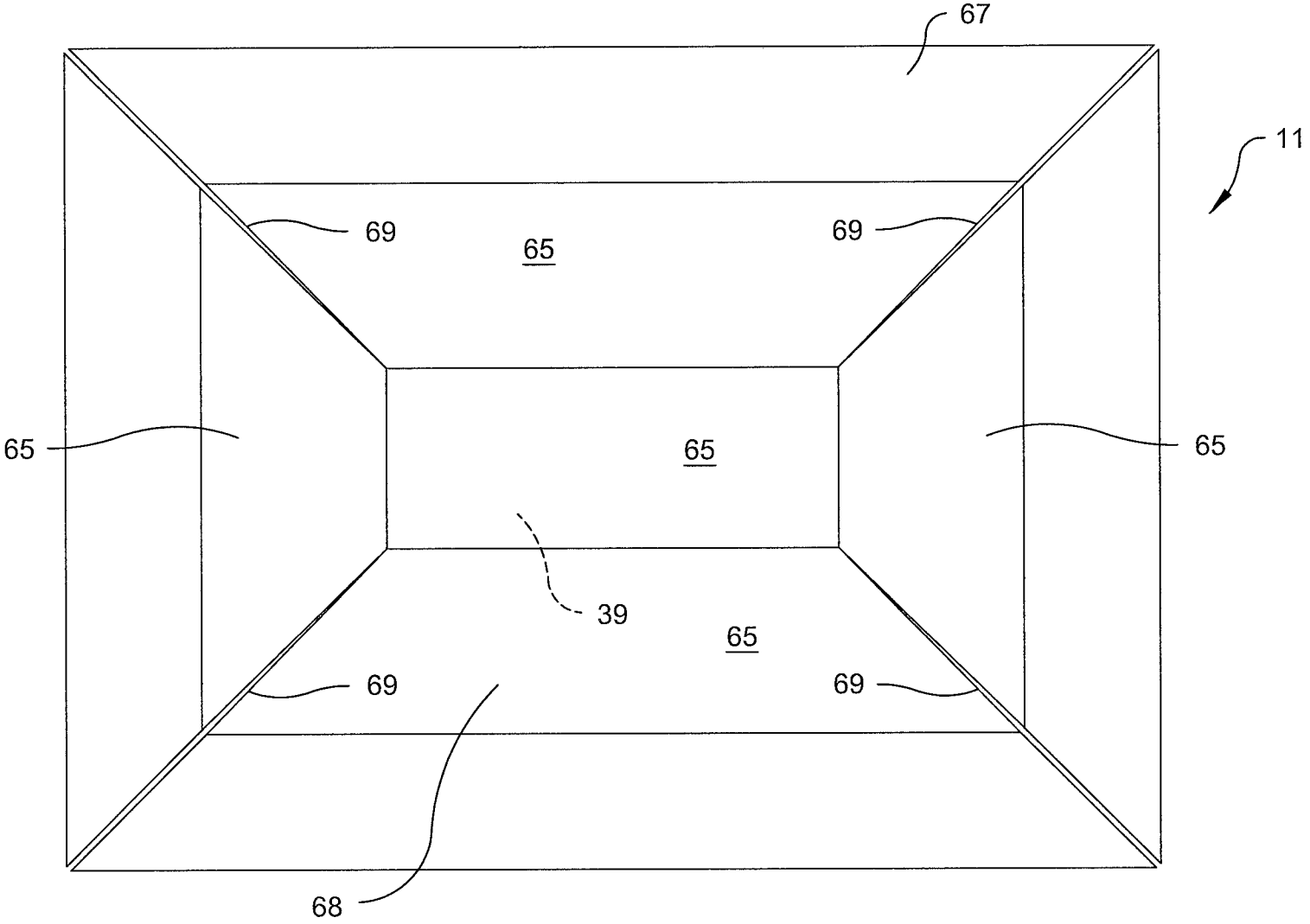
FIG. 11 is a view in top plan of a preferred embodiment of the inventive golf practice device 11, illustrating the location of slits 69 in a one-piece artificial grass carpet 68 of this preferred embodiment.

In a preferred embodiment of the invention shown in FIG. 11, the driving range artificial grass 65 (preferably about 0.5 inches or so in height) and the driving range artificial grass 67 (preferably about 1.5 inches or so in height) are provided as a one-piece artificial grass carpet 68, preferably having a rubber surface on its bottom side to provide further flexibility and "give" or inward movement of the surface of the one-piece artificial grass carpet 68 when struck with a golf club. The one-piece artificial grass carpet 68 is solidly glued down onto the top surface 59 of the pan 35 and the top surface 28 of the outer area 27 of the border portion 19 of the base 13 between the outer edge 24 of the outer area 27 and the outer edge 53 of the lip 42 of the pan 35, and preferably firmly stapled into the top surface 28 of the outer area 27 of the border portion 19 of the base 13 between the outer edge 24 of the outer area 27 and the outer edge 53 of the lip 42 of the pan 35 along the perimeter of the base 13 and especially in the corners of the base 13. Also, preferably, slits 69 are provided in the one-piece artificial grass carpet 68 at each corner, extending from each corner of the flat central portion 39 of the pan 35 out to the closest corner of the base 13, to provide relief to the one-piece artificial grass carpet 68 to permit the one-piece artificial grass carpet 68 to sit closely to the pan 35 and the top surface 28 of the outer area 27 of the border portion 19 of the base 13 between the outer edge 24 of the outer area 27 and the outer edge 53 of the lip 42 of the pan 35 along the varying angled surfaces.

Figure 5:
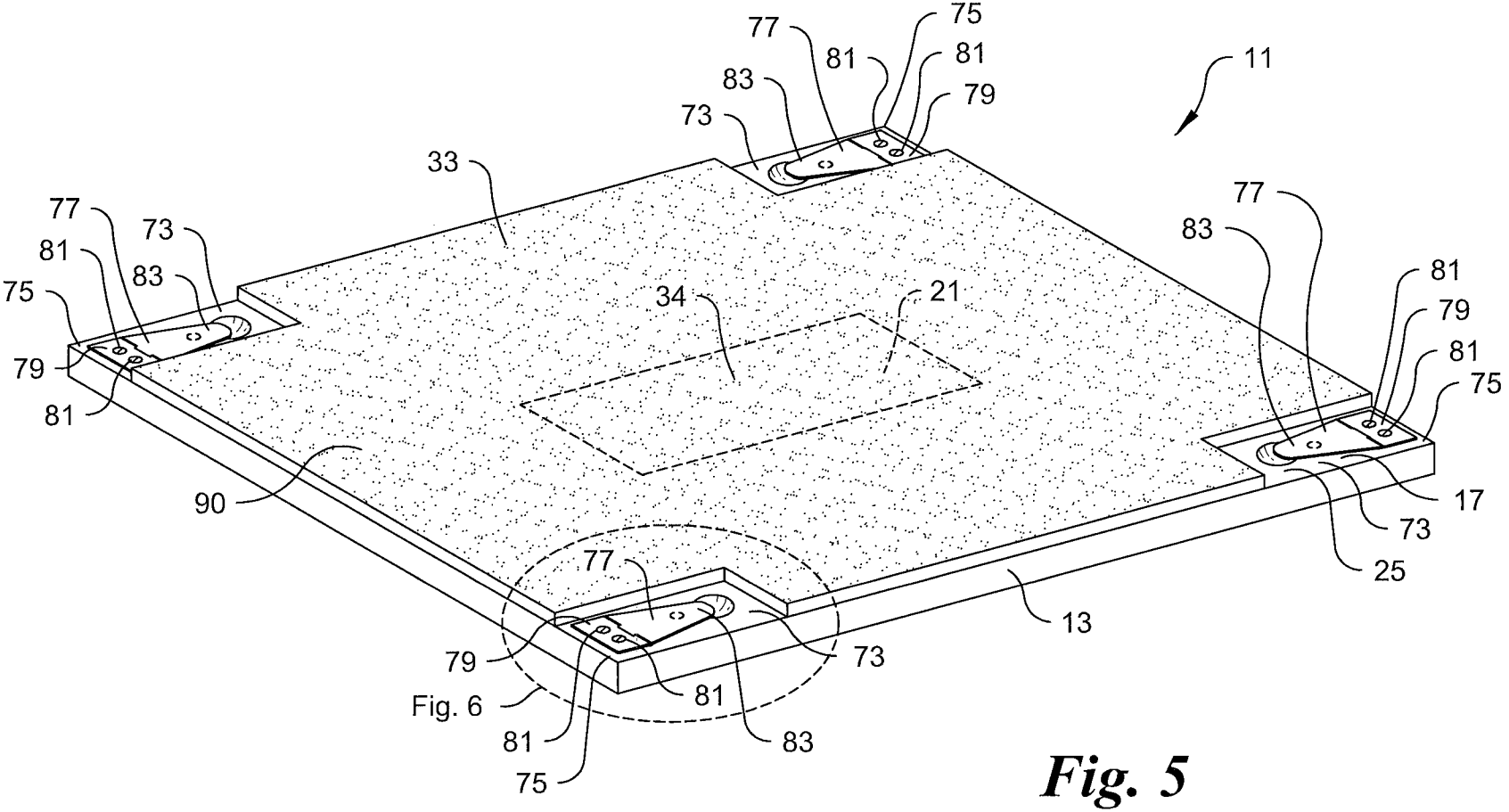
FIG. 5 is a view in perspective showing the bottom side of the golf practice device 11 and anchoring devices mounted to the bottom side 17 of the base 13.

As is shown in FIGS. 3-5, the rubber layer 33 covers the bottom surface 25 of the base 13, except for a section 73 at each corner 75 of the bottom surface 25 of the base 13. That is, the sections 73 of the bottom surface 25 of the base 13 at the four corners 75 of the bottom surface 25 of the base 13 are not covered by the rubber layer 33.

Figure 6:
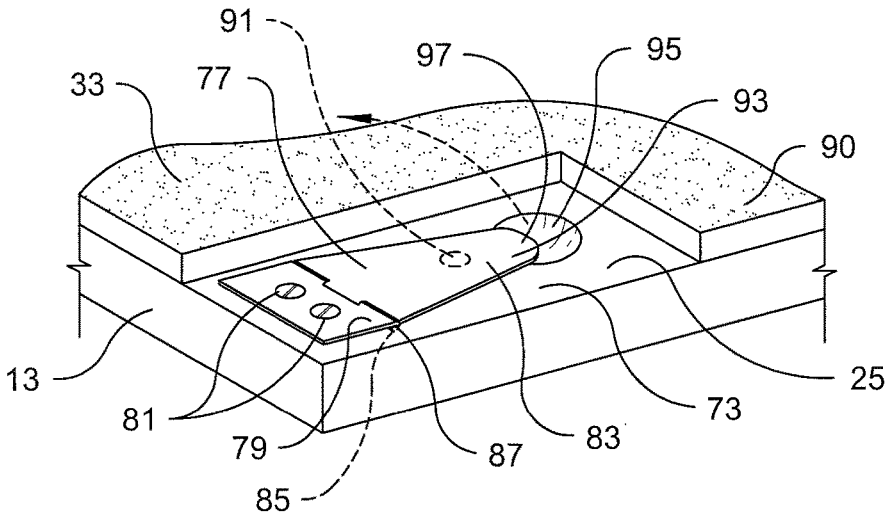
FIG. 6 is an enlarged view in perspective taken from the dashed circle "FIG. 6" shown in FIG. 5 illustrating the details relating to an anchoring device mounted to the bottom side 17 of the base 13, and showing the spike portion 83 of a hinged anchoring device 77 in a retracted position engaged by a magnet 91.
Figure 7:
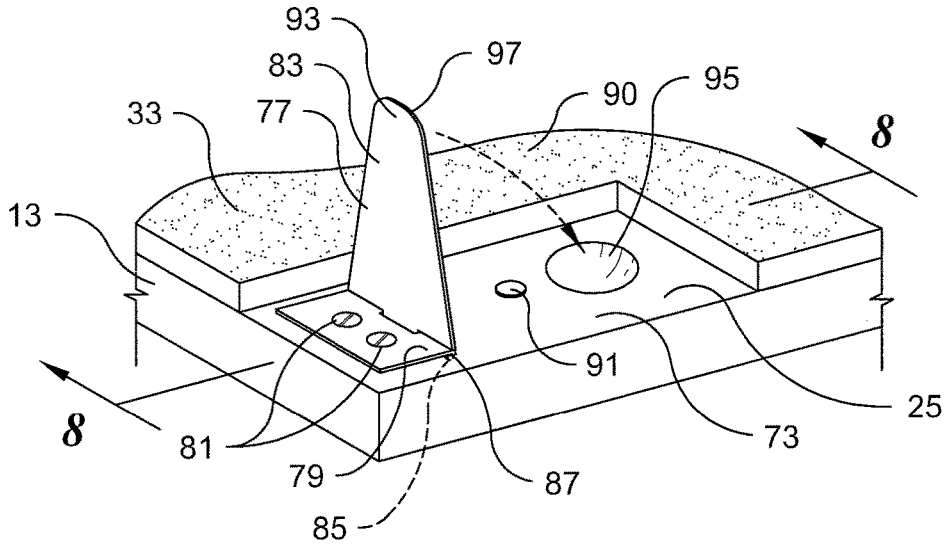
FIG. 7 is an enlarged view in perspective of the anchoring device illustrated in FIG. 6, but showing the spike portion 83 of the hinged anchoring device 77 in an extended position for engaging a natural substrate to anchor the golf practice device 11 to the natural substrate.
Figure 8:
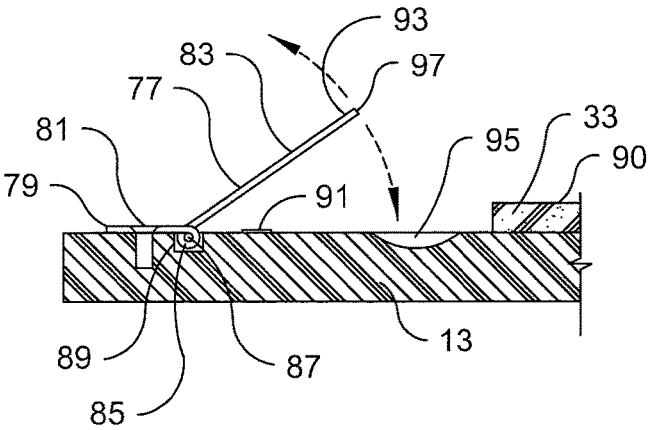
FIG. 8 is a view in cross-section taken along the lines and arrows 8-8 shown in FIG. 7.

An anchoring device, such as a hinged anchoring device 77 shown in the drawings of the preferred embodiment of the invention, is mounted on the bottom side 17 of the base 13 at each section 73 for securing the golf practice device 11 to a natural substrate, such as soil, sand, or grass-covered soil. Each hinged anchoring device 77 has a mounting plate 79 that is secured to the bottom surface 25 of the base 13 at one of the four sections 73 by retaining screws 81, a spike portion 83 that may be hinged or swung downwardly from the bottom side 17 of the base 13 when desired to engage a natural substrate, such as soil, sand, or grass-covered soil, to secure the golf practice device 11 to the natural substrate, and a barrel or knuckle 85 (which is held together with a pin or rod 87 to connect the mounting plate 79 and the spike portion 83 together and enable the spike portion 83 to hinge), around which the spike portion 83 swings from a retracted position as shown in FIG. 6 to an extended position as shown in FIG. 7 for engaging a natural substrate, such as soil, sand, or grass-covered soil. Preferably, a recess 89 is provided in the bottom surface 25 of the base 13 at each section 73 for receiving the barrel or knuckle 85 of the hinged anchoring device 77. The spike portion 83 of each hinged anchoring device 77 may be hinged downwardly away from the bottom surface 25 of the base 13, when desired, to engage a natural substrate, such as soil, sand, or grass-covered soil, to secure the golf practice device 11 to the natural substrate, and the spike portion 83 of each hinged anchoring device 77 may be hinged upwardly toward the bottom surface 25 of the base 13, when desired, such that the hinged anchoring device 77, including the spike portion 83 and the barrel or knuckle 85, is positioned above a plane formed by the bottom surface 90 of the rubber layer 33 when the spike portion 83 is swung upwardly toward the bottom surface 25 of the base 13 to be positioned above the plane formed by the bottom surface 90 of the rubber layer 33 to enable the golf practice device 11 to be put into use after being placed on a flat man-made substrate such as an asphalt driveway, a concrete garage floor, a pavement, a wood deck, or a concrete patio or to store the golf practice device 11 when not in use. When the golf practice device 11 is to be used after being placed upon a man-made substrate such as an asphalt driveway, a concrete garage floor, a pavement, a wood deck, or a concrete patio, prior to placing the golf practice device 11 on the man-made substrate, the spike portion 83 of each hinged anchoring device 77 is hinged upwardly toward the bottom surface 25 of the base 13 such that the entire hinged anchoring device 77 is positioned above the plane formed by the bottom surface 90 of the rubber layer 33 so that the bottom surface 90 of the rubber layer 83 engages the man-made substrate without interference from any of the hinged anchoring devices 77.

Preferably, the hinged anchoring device 77 is made of a metal material, such as brass or steel.

Preferably, as shown in the preferred embodiment of the invention shown in the drawings, a magnet 91 is mounted (preferably using an adhesive) on the bottom surface 25 of the base 13 at each section 73 of the bottom surface 25 of the base 13 not covered by the rubber layer 33. The magnet 91 at each section 73 not covered by the rubber layer 33 is positioned to be aligned with a face of the spike portion 83 of the hinged anchoring device 77 mounted there when the spike portion 83 is swung or hinged to be positioned between the bottom layer 25 of the base 13 and the plane formed by the bottom surface 90 of the rubber layer 33 and in contact with the magnet 91, such that the spike portion 83 at said face is magnetically held to the magnet 91 to secure the spike portion 83 in place when the spike portion 83 is swung or hinged to be positioned between the bottom layer 25 of the base 13 and the plane formed by the bottom surface 90 of the rubber layer 33 and in contact with the magnet 91.

The bottom side 17 of the base 13 at each section 73 of the bottom surface 25 of the base 13 not covered by the rubber layer 33 has a second recess 95 formed therein. The second recess 95 is positioned at each section 73 of the bottom surface 25 of the base 13 next to the magnet 91 affixed to the bottom surface 25 of the base 13 at each section 73 of the bottom surface 25 of the base 13. When the spike portion 83 of the hinged anchoring device 77 has been hinged toward the bottom surface 25 of the base 13 so that the spike portion 83 is positioned between the plane formed by the bottom surface 90 of the rubber layer 33 and the bottom surface 25 of the base 13 and magnetically attached to the magnet 91, a portion of the second recess 95 extends below the ground penetrating end portion 93 of the spike portion 83 of the hinged anchoring device 77 (when the golf practice device 11 is oriented in an up-side down position) and a portion of the second recess 95 extends beyond the distal end 97 of the ground penetrating end portion 93 of the spike portion 83 of the hinged anchoring device 77. Accordingly, the second recess 95 is a finger slot into which a golfer may insert a finger to pull against the surface of the ground penetrating end portion 93 of the spike portion 83 that faces the bottom surface 25 of the base 13 when the spike portion 83 is attached to the magnet 91, to release the spike portion 83 from contact with the magnet 91 and hinge the spike portion 83 outwardly away from the bottom surface 25 of the base 13 so that the spike portion 83 may engage a natural substrate to secure the golf practice device 11 in place on the natural substrate.

To facilitate transporting of the golf practice device 11, preferably, as shown in the preferred embodiment of the invention shown in the drawings, the golf practice device 11 is provided with a handle 99, such as a two hole "strap type" handle, mounted on an end wall 101 of the base 13 with retaining screws 103 that extend through the holes of the handle 99 and into the end wall 101 of the base 13.

To facilitate practicing hitting drives, preferably with a driver or fairway woods, preferably, as shown in the preferred embodiment of the invention shown in the drawings, the golf practice device 11 at each end is provided with a plastic receiver insert 105 mounted in a recess 107 formed in the outer area 27 of the border portion 19 of the base 13. Each plastic receiver insert 105 is designed to accept and hold a golf tee in an upright position so that a golf ball may be placed on top of a golf tee that extends from the plastic receiver insert 105 to elevate the golf ball above the top surface 28 of the outer area 27 of the border portion 19 of the base 13 at a height desired from which to hit a drive.

Preferably, the golf practice device 11 is manufactured by molding the base 13 from a plastic material such as acrylonitrile-butadiene-styrene (ABS), ultra high molecular weight polyethylene (UHMWPE), polypropylene (PP), polyethylene terephthalate (PETE or PET), or polyvinyl chloride (PVC), adhering a rubber layer 33 (which is formed in the shape shown in the drawings or is cut to be formed in the shape shown in the drawings) to the bottom surface 25 of the base 13 using an adhesive, stamping a metal sheet (preferably a steel sheet) to form the pan 35, and securing the pan 35 onto the base 13 with the use of an adhesive and/or retaining screws 71 that extend through the lip 42 of the pan 35 and into the outer portion 27 of the border portion 19 of the base 13 to securely hold the pan 35 to the top side 15 of the base 13. The driving range artificial grass 65 preferably is secured to the top surfaces 45 and 49 preferably with an adhesive, and the driving range artificial grass 67 preferably is secured to the top surface 55 of the lip 42 and the top surface 28 of the outer area 27 of the border portion 19 of the base 13 between the outer edge 24 of the outer area 27 and the outer edge 53 of the lip 42 of the pan 35 with an adhesive. The hinged anchoring devices 77, the magnets 91, and the handle 99 are mounted to the base 13 as discussed above.

In use, the golf practice device 11 of the invention may be used to practice the swings needed to hit various golf shots under conditions encountered on the golf course, such as golf shots from sloping topography. First, a place is chosen to practice the swing needed to hit a golf shot desired to be practiced, such that the topography of the chosen location duplicates the topographical conditions associated with the golf shot to be practiced. Preferably, the place is remote from the golf course and has a substrate on which the golf practice device 11 may be placed and on which a golfer may take a stance to address a golf ball. The substrate of the place chosen to practice, may, for example, be a natural substrate, such as soil, sand, or grass-covered soil, having a sloping topography that matches the sloping topography associated with the golf shot desired to be practiced. Accordingly, in this example, the golfer is replicating at the place chosen to practice the sloping topographical conditions associated with the golf shot to be practiced, so that the swing he/she wishes to practice for a particular golf shot is from the actual sloping topographical conditions associated with the golf shot being practiced. Rather than practicing the swing for a golf shot from a flat, horizontally level surface such as that found at a golf driving range and having to guess at the adjustment needed to that swing when faced with a golf shot on the golf course from sloping topography, the golfer can actually practice the swing needed to hit a golf shot from the actual sloping topographical conditions associated with the golf shot to be practiced.

Next, the golf practice device 11 is oriented on the substrate to replicate the topographical conditions associated with the golf shot to be practiced. For example, if the golf shot to be practiced is one dictated by the sloping topographical conditions associated with the golf shot to be practiced, the golf practice device 11 may be oriented on a natural substrate having the sloping topographical conditions associated with the golf shot to be practiced to replicate the sloping topographical conditions associated with the golf shot to be practiced, and the replicated sloping topographical conditions, in combination with the golf practice device 11 placed thereon, simulate the conditions encountered on a golf course when facing the golf shot that is to be practiced. The golf practice device 11 is then anchored to the natural substrate by using one or more of the hinged anchoring devices 77 by hinging one or more of the spike portions 83 of the hinged anchoring device 77 downwardly so that the ground penetrating end portion 93 of one or more of the spike portions 83 may pierce the natural substrate and the spike portion(s) 83 may be inserted into the natural substrate to secure the golf practice device 11 in place. The swing needed to execute the golf shot desired to be practiced is practiced by hitting golf balls repeatedly off the anchored golf practice device 11 in an effort to become proficient at the golf shot being practiced through repetition. The golfer may hit golf balls off the artificial driving range grass 65 (which simulates golf course fairway), thereby simulating a shot from a golf course fairway. The artificial driving range grass 67 (which simulates golf course rough) affixed to the top surface 55 of the lip 42 of the pan 35 and the top surface 28 of the outer area 27 of the border portion 19 of the base 13 between the outer edge 24 of the outer area 27 and the outer edge 53 of the lip 42 of the pan 35 prevents a golf ball placed on the simulated fairway portion (that is, the driving range artificial grass 65 covering the top surface 45 of the inner slanted portion 43 of the border portion 37 of the pan 35 and the top surface 49 of the flat interior portion 39 of the pan 35) of the golf practice device 11 from rolling off the golf practice device 11, as the simulated rough (the driving range artificial grass 67) has a height that is sufficiently higher than the simulated fairway (driving range artificial grass 65), thereby blocking the ball from rolling off the simulated fairway (driving range artificial grass 65). If desired, the golfer also may practice hitting golf shots from the portion of the golf practice device 11 covered with driving range artificial grass 67, and a golf ball placed on the driving range artificial grass 67 stays in place on the driving range artificial grass 67 due to the consistency and length of the driving range artificial grass 67.

Further, when the golfer wishes to practice hitting another golf shot whose conditions are determined by different topographical conditions, the golfer may move the golf practice device 11 from the original place chosen to practice, and choose a second place to practice hitting the golf shot where conditions are such that they replicate the different topographical conditions associated with the new shot desired to be practiced. The golfer may move the golf practice device 11 to any location that enables the golfer to replicate the topographical conditions associated with any golf shot chosen to be practiced, orient the golf practice device 11 on the substrate of the chosen location to replicate the topographical conditions (for example, sloping conditions) associated with the golf shot chosen to be practiced, anchor the oriented golf practice device 11 in place on the substrate at the chosen location, and then practice the swing needed to execute the golf shot desired to be practiced from the actual topographical conditions associated with the golf shot desired to be practiced by hitting golf balls repeatedly off the golf practice device 11 in an effort to become proficient at the golf shot being practiced through repetition.

In addition to the method of practicing the various swings needed to execute golf shots from different sloping conditions encountered on a golf course during a round of golf, a golfer also may practice the swings needed to hit golf shots using various clubs from a flat, horizontally level surface by placing the golf practice device 11 of the invention on a man-made substrate, such as an asphalt driveway, a concrete garage floor, a pavement, a wood deck, or a concrete patio, to practice such golf shots by hitting golf balls repeatedly off of the golf practice device 11 positioned on the flat, horizontally level man-made surface in an effort to become proficient at the golf shot hit from a flat, horizontally level surface through repetition. When this swing is chosen to be practiced, the golf practice device 11 may be placed on the man-made substrate, with the hinged anchoring devices 77 being positioned above the plane formed by the bottom surface 90 of the rubber layer 33 and preferably with each spike portion 83 magnetically held in place above this plane by the magnet 91 associated with the spike portion 83.

Figure 13:
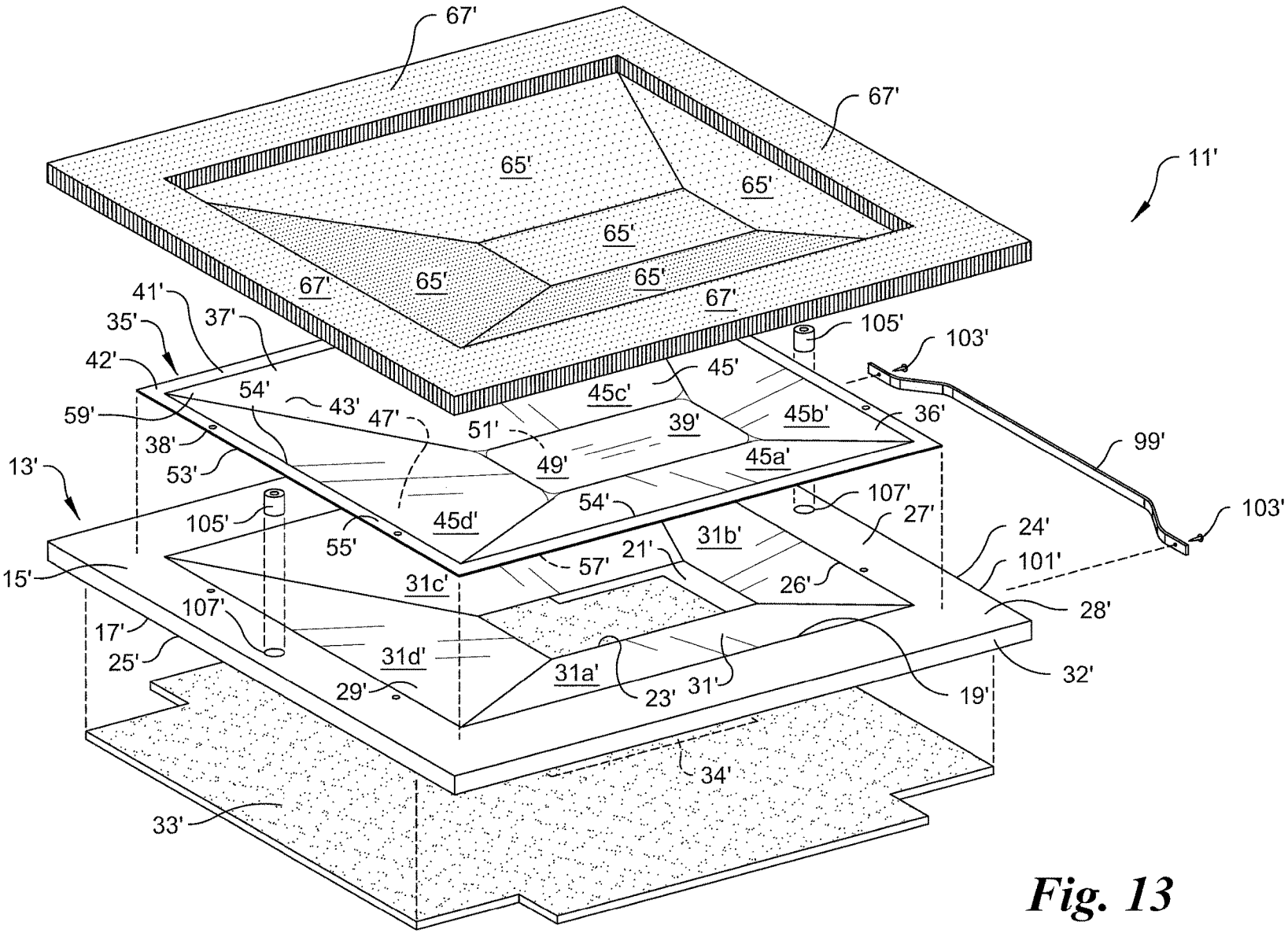
FIG. 13 is an exploded view in perspective of a partial assembly of a portable, lightweight golf practice device 11', constructed in accordance with the invention.
Figure 14:
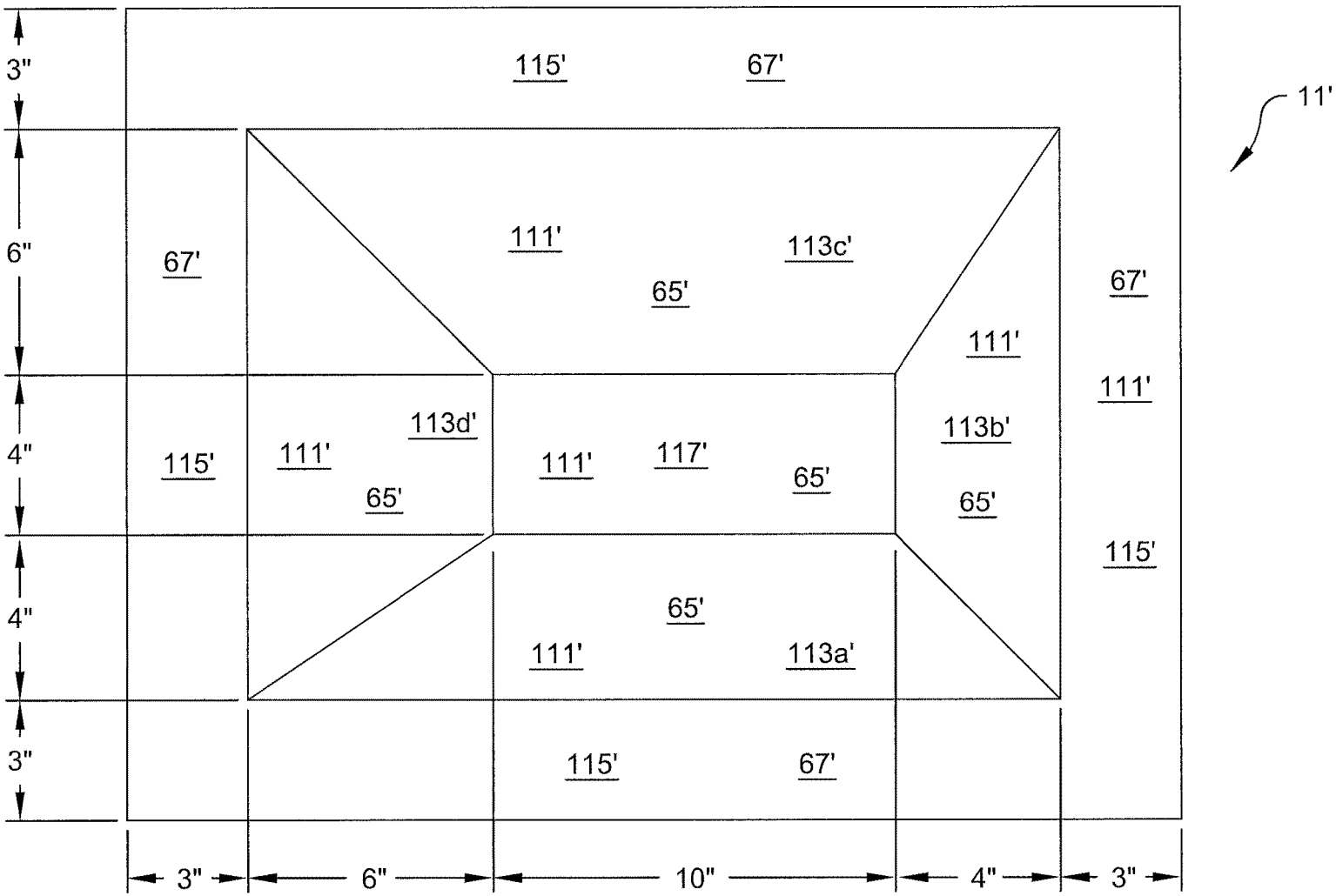
FIG. 14 is a top plan view of the inventive golf practice device 11' of FIG. 13, showing various preferred widths and lengths.

Another preferred embodiment of the invention is shown in FIGS. 13 and 14, which show golf practice device 11'. In the description of golf practice device 11' in this specification and in FIGS. 13 and 14, parts/elements of the golf practice device 11' that are similar to the parts/elements of the golf practice device 11 have been given like reference numerals but followed by the prime symbol. Golf practice device 11' is made (except for the changes in structure described below) and used in substantially the same manner as the golf practice device 11 described above. Golf practice device 11' has substantially the same structure as the golf practice device 11, except that, as shown in FIGS. 13 and 14, the opening 21' of the base 13 'of the golf practice device 11' is offset from the center of the base 13', the flat interior portion 39' of the pan 35' is offset from the center of the pan 35', the width of the inner slanted portion 29' of the base 13' at sections 31*c'* and 31*d'* (measuring by how far inwardly the inner slanted portion 29' extends from the inner edge 26' of the outer area 27' of the border portion 19' of the base 13' to the opening 21' extending through the base 13' at the bottom surface 25' of the base 13', rather than by measuring along the top surface 31' of the inner slanted portion 29' between the inner edge 26' of the outer area 27' of the border portion 19' of the base 13' and the opening 21' extending through the base 13' at the bottom surface 25' of the base 13') is wider (in the exemplary preferred embodiment shown in FIGS. 13 and 14, 6 inches wide) than the width of the inner slanted portion 29' of the base 13' at sections 31*a'* and 31*b'* (measuring by how far inwardly the inner slanted portion 29' extends from the inner edge 26' of the outer area 27' of the border portion 19' of the base 13' to the opening 21' extending through the base 13' at the bottom surface 25' of the base 13', rather than by measuring along the top surface 31' of the inner slanted portion 29' between the inner edge 26' of the outer area 27' of the border portion 19' of the base 13' and the opening 21' extending through the base 13' at the bottom surface 25' of the base 13') (in the exemplary preferred embodiment shown in FIGS. 13 and 14, 4 inches wide), and the width of the inner slanted portion 43' of the pan 35' at section 45*c'* and 45*d'* (measuring by how far inwardly the inner slanted portion 43' extends from inner edge 54' of the lip 42' to the flat interior portion 39' of the pan 35', rather than by measuring along the top surface 45' of the inner slanted portion 43' from the inner edge 54' of the lip 42' to the flat interior portion 39' of the pan 35') is wider (in the exemplary preferred embodiment shown in FIGS. 13 and 14, 6 inches) than the width of the inner slanted portion 43' of the pan 35' at sections 45*a'* and 45*b'* (measuring by how far inwardly the inner slanted portion 43' extends from inner edge 54' of the lip 42' to the flat interior portion 39' of the pan 35', rather than by measuring along the top surface 45' of the inner slanted portion 43' from the inner edge 54' of the lip 42' to the flat interior portion 39' of the pan 35') (in the exemplary preferred embodiment shown in FIGS. 13 and 14, 4 inches wide). In this preferred embodiment, the inner slanted portion 43' of the border portion 37' of the pan 35' is shaped to substantially match the top surface 31' of the inner slanted portion 29' of the border portion 19' of the base 13', the flat interior portion 39' of the pan 35' is shaped to substantially match the perimeter 23' of the opening 21' at the bottom surface 25' of the base 13' such that the flat interior portion 39' of the pan 35' may extend into the opening 21' at the perimeter 23' of the opening 21' at the bottom surface 25' of the base 13', and the lip 42' of the pan 35' is shaped to substantially match a portion of the top surface 28' of the outer area 27' of the border 19' of the base 13'. The pan 35' is positioned on the base 13' such that the inner slanted portion 43' of the border portion 37' of the pan 35' is aligned with and positioned on the inner slanted portion 29' of the border portion 19' of the base 13', with the bottom surface 47' of the inner slanted portion 43' of the pan 35' contacting the top surface 31' of the inner slanted portion 29' of the border portion 19' of the base 13', and the flat interior portion 39' of the pan 35' is aligned with the opening 21' extending through the base 13', with the bottom surface 51' of the flat interior portion 39' of the pan 35' extending into the opening 21' and contacting the portion 34' of the rubber layer 33' that extends across the opening 21' in the base 13'. Also, the lip 42' of pan 35' is aligned with and positioned on the outer area 27' of the border portion 19' of the base 13' with the bottom surface 57' of the lip 42' resting upon a portion of the top surface 28' of the outer area 27' of the border portion 19' of the base 13'. Accordingly, the pan 35' sits snugly on the base 13' since the shape and dimensions of the bottom side 38' of the pan 35' substantially match the shape and dimensions of the top side 15' of the base 13', with the lip 42' of the pan 35' positioned on a portion of the outer area 27' of the border portion 19' of the base 13', with the inner slanted portion 43' of the border portion 37' of the pan 35' positioned on the inner slanted portion 29' of the border portion 19' of the base 13', and the flat interior portion 39' of the pan 35' extending into the opening 21' in the base 13' filling the opening 21' in the base 13' at the bottom surface 25' of the base 13' and positioned on the portion 34' of the rubber layer 33' that extends across the opening 21' in the base 13'.

FIG. 14 illustrates exemplary preferred dimensions of hitting area (that is, the top surface 111' of the golf practice device 11') of the golf practice device 11'. In this example, the top surface 111' of the golf practice device 11' includes four inner slanting portions 113*a*', 113*b*', 113*c*', and 113*d*', which are surrounded by a border portion 115' and surround a portion 117'. The four inner slanting portions 113*a*', 113*b*', 113*c*', and 113*d*' of the top surface 111' and portion 117' of the top surface 111' comprise driving range artificial grass 65', preferably driving range artificial grass that simulates golf course fairway. The driving range artificial grass 65' preferably is about 0.5 inches or so in height. The border portion 115' of the top surface 111' comprises driving range artificial grass 67', preferably driving range artificial grass that simulates golf course rough. The driving range artificial grass 67' preferably is about 1.5 inches or so in height. The shape (including width and length) of the inner slanting portion 113*a*' substantially matches the shape of the inner slanted portion 43' at section 45*a*' and the shape of the inner slanted portion 29' at section 31*a*', the shape (including width and length) of the inner slanting portion 113*b*' substantially matches the shape of the inner slanted portion 43' at section 45*b*; and the shape of the inner slanted portion 29' at section 31*b*', the shape (including width and length) of the inner slanting portion 113*c*' substantially matches the shape of the inner slanted portion 43' at section 45*c*' and the shape of the inner slanted portion 29' at section 31*c*', and the shape (including width and length) of the inner slanting portion 113*d*' substantially matches the shape of the inner slanted portion 43' at section 45*d*' and the shape of the inner slanted portion 29' at section 31*d*'. The inner slanting portion 113*a*' is aligned with slanted portion 43' at section 45*a*' and with inner slanted portion 29' at section 31*a*', the inner slanting portion 113*b*' is aligned with slanted portion 43' at section 45*b*' and with inner slanted portion 29' at section 31*b*', the inner slanting portion 113*c*' is aligned with slanted portion 43' at section 45*c*" and with the inner slanted portion 29' at section 31*c*', and the inner slanting portion 113*d*' is aligned with slanted portion 43' at section 45*d*' and with the inner slanted portion 29' at section 31*d*'.

The 6 inch wide inner slanting portions 113*c*' and 113*d*' and the 4 inch wide inner slanting portions 113*a*" and 113*b*' add versatility to the golf practice device 11' by creating a flatter set of angles between the inner slanting portion 113*c*' and the border portion 115', between the inner slanting portion 113*c*' and the portion 117', between the inner slanting portion 113*d*' and the portion 115', and between the inner slanting portion 113*d*' and the portion 117', as compared to a steeper set of angles between the inner slanting portion 113*a*" and the border portion 115', between the inner slanting portion 113*a*' and the portion 117', between the inner slanting portion 113*b*' and the border portion 115', and between the inner slanting portion 113*b*" and the portion 117'. Accordingly, a user of the golf practice device 11' may place the golf practice device 11' on a hill or mound for use, and then optimize the positioning of the ball on the surface of the golf practice device 11' by (with the rubber layer 33 always facing downward toward the surface of the hill or mound) rotating the golf practice device 11' in its position on the hill or mound to position a portion of the top surface 111' of the golf practice device 11' in a desired plane with respect to the user of the golf practice device 11' to create an appropriate lie for a ball sitting on the top surface 111' for the golf shot to be practiced. By having a set of flatter angles and a set of steeper angles between the inner slanting portions 113*a*', 113*b*', 113*c*', and 113*d*' and the border portion 115' and the portion 117', arriving at the desired plane to create the lie for a golf ball that fits the golf shot to be practiced is more easily accomplished.

As used herein, the term "golf course" means an area of land laid out for golf, typically with a series of 9 or 18 holes, each of which typically consists of a teeing ground, a fairway, rough and hazards, and a green, and the term "away from the golf course" means any area not forming the "golf course", such as a golfer's backyard, a local park, a field, a beach, an asphalt driveway, a concrete garage floor, a pavement, a wood deck, or a concrete patio.

As used herein, practicing a golf shot means practicing the golf swing needed to execute a golf shot by repeatedly hitting golf balls from a position that replicates the topographical conditions associated with the golf shot being practiced.

Also, as used herein, "proficient at the golf shot being practiced" means executing the golf shot such that the golfer is consistently hitting golf balls solidly with a golf club to propel each golf ball that is hit a desired distance to a desired location.

To be clear, when the term "natural substrate" is used herein, it means a substrate such as soil, sand, grass-covered soil, and the like, and when the term "man-made substrate" is used herein, it means a substrate such as an asphalt driveway, a concrete garage floor, a pavement, a wood deck, a concrete patio, and the like.

The invention claimed is:

1. A portable, lightweight golf practice device from which to hit golf balls, comprising a base having a top side, a bottom side, a border portion, and an opening extending through the base and surrounded by the border portion, the opening having a perimeter, the bottom side of the base having a bottom surface, the border portion of the base having an outer area and an inner slanted portion that slopes downwardly from the outer area of the border portion of the base to the opening, the inner slanted portion of the border portion of the base having a top surface, a pan having a border portion and a flat interior portion surrounded by the border portion of the pan, the border portion of the pan having an outer area and an inner slanted portion that slopes downwardly from the outer area of the border portion of the pan to the flat interior portion of the pan, the inner slanted portion of the border portion of the pan having a top surface and a bottom surface, the flat interior portion of the pan having a top surface and a bottom surface, the pan having a thickness that is substantially the same throughout, the inner slanted portion of the border portion of the pan having a shape that substantially matches the top surface of the inner slanted portion of the border portion of the base, and the flat interior portion of the pan having a shape that substantially matches the perimeter of the opening in the base, and a rubber layer affixed to the bottom surface of the base, the rubber layer having a portion that extends across the opening in the base, and the rubber layer having a bottom surface, the pan being positioned on the base such that the inner slanted portion of the border portion of the pan is aligned with and positioned on the inner slanted portion of the border portion of the base and the flat interior portion of the pan is aligned with the opening extending through the base, the bottom surface of the flat interior portion of the pan contacting the portion of the rubber layer that extends across the opening in the base, and the top surface of the inner slanted portion of the border portion of the pan and the top surface of the flat interior portion of the pan being covered with driving range artificial grass.

2. The portable, lightweight golf practice device of claim 1, the base being rectangular in shape.

3. The portable, lightweight golf practice device of claim 2, the base having a width of about 18 inches and a length of about 24 inches.

4. The portable, lightweight golf practice device of claim 1, the base having an outer periphery formed by the border portion of the base, the border portion of the base at the outer periphery of the base being about ⅞ inches in height.

5. The portable, lightweight golf practice device of claim 1, the base being made of strong plastic material.

6. The portable, lightweight golf practice device of claim 5, the strong plastic material being acrylonitrile-butadiene-styrene (ABS), ultra high molecular weight polyethylene (UHMWPE), polypropylene (PP), polyethylene terephthalate (PETE or PET), or polyvinyl chloride (PVC).

7. The portable, lightweight golf practice device of claim 1, the opening being rectangular in shape and having a width of about 4 inches and a length of about 10 inches.

8. The portable, lightweight golf practice device of claim 1, the outer area of the border portion of the pan comprising a lip that is aligned with and positioned on the outer area of the border portion of the base.

9. The portable, lightweight golf practice device of claim 8, the lip being secured to the outer area of the border portion of the base by screws extending through the lip and into the outer area of the border portion of the base.

10. The portable, lightweight golf practice device of claim 8, the lip having a top surface covered with driving range artificial grass.

11. The portable, lightweight golf practice device of claim 10, the driving range artificial grass covering the top surface of the lip simulating golf course rough.

12. The portable, lightweight golf practice device of claim 11, the driving range artificial grass covering the top surface of the inner slanted portion of the border portion of the pan and the top surface of the flat interior portion of the pan simulating a golf course fairway.

13. The portable, lightweight golf practice device of claim 11, the outer area of the border portion of the base having a top surface, the lip of the pan covering only a portion of the top surface of the outer area of the border portion of the base, and the top surface of the outer area of the border portion of the base not covered by the lip of the pan being covered with driving range artificial grass simulating golf course rough.

14. The portable, lightweight golf practice device of claim 1, the pan being made of sheet metal.

15. The portable, lightweight golf practice device of claim 1, the driving range artificial grass simulating a golf course fairway.

16. The portable, lightweight golf practice device of claim 1, the rubber layer not covering a section of the bottom surface of the base, and further including an anchoring device mounted on the bottom side of the base at said section not covered by the rubber layer for securing the golf practice device to a natural substrate.

17. The portable, lightweight golf practice device of claim 1, the rubber layer not covering a section of the bottom surface of the base in each corner of the bottom surface of the base of the golf practice device, and further including a hinged anchoring device mounted on the bottom side of the base at each said section not covered by the rubber layer for securing the golf practice device to a natural substrate, each hinged anchoring device having a spike portion that extends downwardly from the bottom surface of the base when swung to extend downwardly to engage a natural substrate to secure the golf practice device to the natural substrate, and each hinged anchoring device, including the spike portion of each, being positioned above a plane formed by the bottom surface of the rubber layer, when the spike portion is swung to be positioned above the plane formed by the bottom surface of the rubber layer, to enable the golf practice device to be put into use after being placed on a flat man-made substrate, or to store the golf practice device when not in use.

18. The portable, lightweight golf practice device of claim 17, the spike portion of each hinged anchoring device being made of a metal material, and the spike portion having a ground penetrating end portion, a magnet mounted on the bottom side of the base at each said section not covered by the rubber layer, the magnet at each said section not covered by the rubber layer being aligned with the spike portion of the hinged anchoring device mounted there such that the spike portion is magnetically held to the magnet to secure the spike portion in place when the spike portion is swung to be positioned above the plane formed by the bottom surface of the rubber layer, the bottom side of the base at each said section not covered by the rubber layer having a recess formed therein that is aligned with and extends just beyond the ground penetrating end portion of the spike portion positioned there when the spike portion is positioned above the plane formed by the bottom surface of the rubber layer to facilitate access to the ground penetrating end portion of the spike portion so that the ground penetrating end portion of the spike portion may be grabbed, disengaged from the magnet, and hinged downwardly to engage a natural substrate when it is desired to secure the golf practice device to the natural substrate.

19. The portable, lightweight golf practice device of claim 1, the base being rectangular in shape, the base having a width of about 18 inches and a length of about 24 inches, the base having an outer periphery formed by the border portion of the base, the border portion of the base at the outer periphery of the base being about ⅞ inches in height, the base being made of strong plastic material, the strong plastic material being acrylonitrile-butadiene-styrene (ABS), ultra high molecular weight polyethylene (UHMWPE), polypropylene (PP), polyethylene terephthalate (PETE or PET), or polyvinyl chloride (PVC), the opening being rectangular in shape and having a width of about 4 inches and a length of about 10 inches, the outer area of the border portion of the pan comprising a lip that is aligned with and positioned on the outer area of the border portion of the base, the lip being secured to the outer area of the border portion of the base by screws extending through the lip and into the outer area of the border portion of the base, the pan being made of sheet metal, the lip having a top surface covered with driving range artificial grass, the driving range artificial grass covering the top surface of the lip simulating golf course rough, the driving range artificial grass covering the top surface of the inner slanted portion of the border portion of the pan and the top surface of the flat interior portion of the pan simulating a golf course fairway, the outer area of the border portion of the base having a top surface, the lip of the pan covering only a portion of the top surface of the outer area of the border portion of the base, and the top surface of the outer area of the border portion of the base not covered by the lip of the pan being covered with driving range artificial grass simulating golf course rough, the rubber layer not covering a section of the bottom surface of the base in each corner of the golf practice device, and further including a hinged anchoring device mounted on the bottom side of the base at each said section not covered by the rubber layer for securing the golf practice device to a natural substrate, each hinged anchoring device having a spike portion that extends downwardly from the bottom surface of the base when swung to extend downwardly to engage a natural substrate to secure the golf practice device to the natural substrate, and each hinged anchoring device, including the spike portion of each, being positioned above a plane formed by the bottom surface of the rubber layer, when the spike portion is swung to be positioned above the plane formed by the bottom surface of the rubber layer, to enable the golf practice device to be put into use after being placed on a flat man-made substrate, or to store the golf practice device when not in use, the spike portion of each hinged anchoring device being made of a metal material, and the spike portion having a ground penetrating end portion, and further including a magnet mounted on the bottom side of the base at each said section not covered by the rubber layer, the magnet at each said section not covered by the rubber layer being aligned with the spike portion of the hinged anchoring device mounted there such that the spike portion is magnetically held to the magnet to secure the spike portion in place when the spike portion is swung to be positioned above the plane formed by the bottom surface of the rubber layer, and the bottom side of the base at each said section not covered by the rubber layer having a recess formed therein that is aligned with and extends just beyond the ground penetrating end portion of the spike portion positioned there when the spike portion is positioned above the plane formed by the bottom surface of the rubber layer to facilitate access to the ground penetrating end portion of the spike portion so that the ground penetrating end portion of the spike portion may be grabbed, disengaged from the magnet, and hinged downwardly to engage a natural substrate when it is desired to secure the golf practice device to the natural substrate.

20. A method of practicing hitting a golf shot under conditions encountered on a golf course while playing golf, comprising the steps of providing the portable, lightweight golf practice device of claim 19, choosing a place to practice hitting a golf shot from a sloping topography, the place being remote from a golf course, the place having a substrate on which the golf practice device may be placed and on which a golfer may take a stance to address a golf ball, the substrate of the place chosen to practice having a sloping topography needed to replicate sloping topographical conditions associated with the golf shot to be practiced, the sloping topography affecting the stance of the golfer and position of a golf ball with respect to the golfer when the golfer has taken a stance to address a golf ball, the substrate being soil, sand, or grass-covered soil, orienting the golf practice device on the substrate to replicate sloping topographical conditions associated with the golf shot to be practiced, the sloping topographical conditions, in combination with the golf practice device placed thereon, simulating conditions encountered on a golf course when facing the golf shot that is to be practiced, anchoring the golf practice device to the substrate, and practicing the golf shot by hitting golf balls repeatedly off the anchored golf practice device in an effort to become proficient at the golf shot through repetition.

21. The portable, lightweight golf practice device of claim 1, the opening being rectangular in shape and having a first side, a second side, a third side, and a fourth side, the flat interior portion being rectangular in shape and having a first side, a second side, a third side, and a fourth side, the first side of the opening being aligned with the first side of the flat interior portion of the pan, the second side of the opening being aligned with the second side of the flat interior portion of the pan, the third side of the opening being aligned with the third side of the flat interior portion of the pan, and the fourth side of the opening being aligned with the fourth side of the flat interior portion of the pan, the inner slanted portion of the border portion of the base having a width that is wider on the third and fourth sides of the opening than it is on the first and second sides of the opening, and the inner slanted portion of the border portion of the pan having a width that is wider on the third and fourth sides of the flat interior portion of the pan than it is on the first and second sides of the pan.

22. The portable, lightweight golf practice device of claim 1, the opening being rectangular in shape and having a first side, a second side, a third side, and a fourth side, the flat interior portion being rectangular in shape and having a first side, a second side, a third side, and a fourth side, the first side of the opening being aligned with the first side of the flat interior portion of the pan, the second side of the opening being aligned with the second side of the flat interior portion of the pan, the third side of the opening being aligned with the third side of the flat interior portion of the pan, and the fourth side of the opening being aligned with the fourth side of the flat interior portion of the pan, the inner slanted portion of the border portion of the base having a 6 inch width on the third and fourth sides of the opening and a 4 inch width on the first and second sides of the opening, and the inner slanted portion of the pan having a 6 inch width on the third and fourth sides of the flat interior portion of the pan and a 4 inch width on the first and second sides of the flat interior portion of the pan.

23. A method of practicing hitting a golf shot under conditions encountered on a golf course while playing golf, comprising the steps of providing the portable, lightweight golf practice device of claim 1, choosing a place to practice hitting a golf shot from a sloping topography, the place being remote from a golf course, the place having a substrate on which the golf practice device may be placed and on which a golfer may take a stance to address a golf ball, the substrate of the place chosen to practice having a sloping topography needed to replicate sloping topographical conditions associated with the golf shot to be practiced, the sloping topography affecting the stance of the golfer and position of a golf ball with respect to the golfer when the golfer has taken a stance to address a golf ball, the substrate being soil, sand, or grass-covered soil, orienting the golf practice device on the substrate to replicate sloping topographical conditions associated with the golf shot to be practiced, the sloping topographical conditions, in combination with the golf practice device placed thereon, simulating conditions encountered on a golf course when facing the golf shot that is to be practiced, anchoring the golf practice device to the substrate, and practicing the golf shot by hitting golf balls repeatedly off the anchored golf practice device in an effort to become proficient at the golf shot through repetition.

24. A method of practicing a varied assortment of golf shots encountered on a golf course while playing golf, comprising the steps of (a) providing the portable, lightweight golf practice device of claim 1, (b) choosing a place to practice hitting a first golf shot from a sloping topography, the place being remote from a golf course, the place having a substrate on which the golf practice device may be placed and on which a golfer may take a stance to address a golf ball, the substrate of the place chosen to practice having a sloping topography needed to replicate sloping topographical conditions associated with the first golf shot to be practiced, the sloping topography affecting the stance of the golfer and position of a golf ball with respect to the golfer when the golfer has taken a stance to address a golf ball, the substrate being soil, sand, or grass-covered soil, (c) orienting the golf practice device on the substrate to replicate sloping topographical conditions associated with the first golf shot to be practiced, the sloping topographical conditions, in combination with the golf practice device placed thereon, simulating conditions encountered on a golf course when facing the first golf shot that is to be practiced, (d) anchoring the golf practice device to the substrate, (e) practicing the first golf shot by hitting golf balls repeatedly off the anchored golf practice device in an effort to become proficient at the first golf shot through repetition, (f) completing practicing the first golf shot, (g) removing the golf practice device from the substrate, (h) repeating steps (b), (c), (d), and (e) set out above but to practice a second golf shot instead of the first golf shot using a substrate having a sloping topography needed to replicate sloping topographical conditions associated with the second golf shot to be practiced, (i) completing practicing the second golf shot, (j) removing the golf practice device from the substrate, (k) repeating steps (b), (c), (d), and (e) set out above but to practice a third golf shot instead of the first golf shot using a substrate having a sloping topography needed to replicate sloping topographical conditions associated with the third golf shot to be practiced, (l) completing practicing the third golf shot, and (m) removing the golf practice device from the substrate.

* * * * *